US012339091B2

(12) United States Patent
Barnett

(10) Patent No.: US 12,339,091 B2
(45) Date of Patent: Jun. 24, 2025

(54) CROSSBOW WITH MOVABLE TRIGGER LATCH BLOCK

(71) Applicant: Barnett Outdoors, LLC, Tarpon Springs, FL (US)

(72) Inventor: David A. Barnett, Tampa, FL (US)

(73) Assignee: Barnett Outdoors, LLC, Tarpon Springs, FL (US)

( * ) Notice: Subject to any disclaimer, the term of this patent is extended or adjusted under 35 U.S.C. 154(b) by 251 days.

(21) Appl. No.: 18/188,775

(22) Filed: Mar. 23, 2023

(65) Prior Publication Data

US 2023/0221089 A1 Jul. 13, 2023

Related U.S. Application Data

(63) Continuation-in-part of application No. 17/827,370, filed on May 27, 2022, now Pat. No. 11,874,085.

(60) Provisional application No. 63/322,891, filed on Mar. 23, 2022, provisional application No. 63/194,557, filed on May 28, 2021.

(51) Int. Cl.

| | |
|---|---|
| ***F41B 5/12*** | (2006.01) |
| ***F41A 19/10*** | (2006.01) |
| ***F41B 5/14*** | (2006.01) |

(52) U.S. Cl.

CPC ..... *F41B 5/12* (2013.01); *F41A 19/10* (2013.01); *F41B 5/1469* (2013.01)

(58) Field of Classification Search

CPC ..... F41B 5/12; F41B 5/123

See application file for complete search history.

(56) References Cited

U.S. PATENT DOCUMENTS

| | | | |
|---|---|---|---|
| 6,874,491 | B2 | 4/2005 | Bednar |
| 6,895,950 | B2 | 5/2005 | Gillet et al. |
| 7,204,242 | B2 | 4/2007 | Dziekan |
| 7,363,921 | B2 | 4/2008 | Kempf |
| 7,784,453 | B1 | 8/2010 | Yehle |
| 7,810,480 | B2 | 10/2010 | Shepley et al. |
| 7,836,871 | B2 | 11/2010 | Kempf |
| 7,997,258 | B2 | 8/2011 | Shepley et al. |
| 8,104,461 | B2 | 1/2012 | Kempf |
| D654,133 | S | 2/2012 | Barnett |
| 8,136,514 | B2 | 3/2012 | Howard et al. |
| 8,240,299 | B2 | 8/2012 | Kronengold et al. |
| 8,443,790 | B2 | 5/2013 | Pestrue |
| 8,453,631 | B1 | 6/2013 | Kronengold et al. |
| 9,341,434 | B2 | 5/2016 | McPherson et al. |

(Continued)

OTHER PUBLICATIONS

U.S. Appl. No. 17/738,811, filed May 6, 2022, titled "Multi-Stroke Lever Action Crossbow.".

(Continued)

*Primary Examiner* — John A Ricci

(74) *Attorney, Agent, or Firm* — Jones Walker LLP

(57) ABSTRACT

A crossbow with a movable trigger latch block. The crossbow has a trigger latch block slidingly connected to the flight track. The trigger latch block is configured to engage and retain the bowstring. A cocking mechanism is configured to draw the trigger latch block with the bowstring from an initial position near a forward end of the flight track to a cocked position. A one-way retention mechanism is configured to immobilize the trigger latch block against linear movement in a forward direction along the flight track. A trigger-traverse mechanism is configured to slide the trigger latch block in a forward direction to its initial position after the bowstring is released.

27 Claims, 29 Drawing Sheets

(56) References Cited

U.S. PATENT DOCUMENTS

| | | | |
|---|---|---|---|
| 9,354,015 | B2 | 5/2016 | Yehle |
| 9,404,706 | B2 | 8/2016 | Khoshnood |
| 9,494,379 | B2 | 11/2016 | Yehle |
| 9,494,380 | B1 | 11/2016 | Yehle |
| 9,528,792 | B1 | 12/2016 | Chang |
| 9,557,134 | B1 | 1/2017 | Yehle |
| 9,568,269 | B1 | 2/2017 | Chang |
| 9,958,232 | B1 | 5/2018 | Egerdee et al. |
| 10,077,965 | B2 | 9/2018 | Yehle |
| 10,082,359 | B2 | 9/2018 | Yehle |
| 10,126,088 | B2 | 11/2018 | Yehle |
| 10,175,023 | B2 | 1/2019 | Yehle |
| 10,175,025 | B1 | 1/2019 | Fehringer |
| 10,254,073 | B2 | 4/2019 | Yehle |
| 10,260,835 | B2 | 4/2019 | Pulkrabek |
| 10,295,295 | B2 | 5/2019 | Shaffer et al. |
| 10,378,853 | B1 | 8/2019 | Liu |
| 10,495,403 | B1 | 12/2019 | Liu |
| 10,670,368 | B1 | 6/2020 | Liu |
| 10,690,436 | B1 | 6/2020 | Kempf et al. |
| 10,900,737 | B1 | 1/2021 | Hansel et al. |
| 10,900,738 | B1 | 1/2021 | Hensel et al. |
| 11,085,728 | B2 | 8/2021 | Yehle |
| 11,221,191 | B2 | 1/2022 | Bednar et al. |
| 11,236,963 | B2 | 2/2022 | Bednar et al. |
| 11,236,964 | B2 | 2/2022 | Bednar et al. |
| 2006/0144381 | A1 | 6/2006 | Kempf et al. |
| 2010/0170488 | A1 | 7/2010 | Rasor et al. |
| 2018/0321011 | A1 | 11/2018 | Yehle |
| 2020/0109911 | A1 | 4/2020 | McPherson et al. |

OTHER PUBLICATIONS

PCT International Searching Authority/US, International Search Report and Written Opinion, mailed Sep. 2, 2022, application No. PCT/US2022/031413.

CROSSBOW WITH MOVABLE TRIGGER LATCH BLOCK

CROSS-REFERENCE TO RELATED APPLICATION

This application is a non-provisional of, and claims the benefit of and priority to, U.S. Provisional Patent Application No. 63/322,891, filed on Mar. 23, 2022, and is a continuation-in-part of U.S. patent application Ser. No. 17/827,370, filed on May 27, 2022, which claims the benefit of, and priority to, U.S. Provisional Patent Application No. 63/194,557, filed on May 28, 2021, each of which is incorporated herein by reference in its entirety.

FIELD OF THE INVENTION

This invention relates to weapons. More specifically, it relates to a crossbow with a movable trigger latch block.

BACKGROUND

Current marketplace has several models of pistol crossbows that shoot short arrows, commonly referred to as "bolts." One type of a pistol crossbow is known as a break-action crossbow, originally designed by the company named BARNETT and sold under the COMMANDO trademark. A break-action crossbow generally functions in the following manner: a cocking mechanism draws a bowstring from its rest position to its fully drawn position in one continuous stroke. The cocking mechanism involves at least one longitudinal arm terminating in a hook, wherein the arm is pivotally attached to the rear stock portion of the crossbow. To cock the crossbow, a user rotates the rear stock in a downward direction relative to the body of the crossbow. This breaking motion causes the cocking arm to longitudinally translate along the body of the crossbow. As the cocking arm moves back relative to the crossbow body, the hook draws the bowstring toward its cocked position.

Currently known break-action crossbow cocking mechanisms draw the bowstring from its rest position to its fully drawn position in one continuous stroke. A major flaw of such single-stroke cocking mechanism is that it requires a high degree of strength from the user. To reduce the amount of force needed to cock such crossbow, many manufacturers limit the amount of bowstring draw weight, which, in turn, limits the range and accuracy of the crossbow. Furthermore, the cocking arms are generally positioned outside of the crossbow track, and, therefore, may present a safety concern and be prone to damage.

Another problem associated with currently known crossbows pertains to crossbows utilizing movable trigger latch mechanisms. This mechanism generally involves a movable trigger latch block. The trigger latch block is configured to engage the bowstring, draw the bowstring back into its fully cocked position, and, after the shot, the user must bring the trigger latch block into its initial position, at the front of the flight track. Typical trigger-traverse crossbows require that, after the shot, the user must release the trigger latch block and then, manually push the trigger latch block forward along the flight track until it captures the bowstring. This manual step of returning the trigger latch block to its initial position slows down the rate at which the crossbow can be reloaded. Furthermore, because the user must have physical access to the trigger latch to move it along the flight track, the flight track cannot be obstructed by a scope, a bridge, or another structural component of the crossbow. Therefore, the traditional movable trigger latch mechanism limits the design options for the crossbow.

There are some models of movable trigger latch crossbows that use a winding mechanism to move the trigger latch block along the flight track. Most of these models rely on belts and cables to move the trigger latch block along the flight track. Although not prevalent in the art, some models of crossbows have cocking mechanisms that use a lead screw to move the trigger latch block along the flight track. The lead screw is screw-threadedly connected to the trigger latch block, wherein rotation of the lead screw about the center axis causes the trigger latch block to move linearly along the flight track of the crossbow. In these models, the user must spin the lead screw to linearly translate the latch block. To reduce the amount of force needed to cock the crossbow, the lead screw will typically have a shallow, low-helix thread pitch (less than 10 mm). The shallow pitch reduces the amount of strength needed to spin the lead screw to translate the load bearing trigger latch block toward the fully drawn position.

However, these types of winding mechanisms have several major flaws. Although the shallow pitch of the lead screw reduces the amount of force needed to cock the crossbow, it also limits any form of manual linear override. Thus, the only way to move the trigger latch block either forward or backward along the flight track of the crossbow is by spinning the lead screw. This can be accomplished via a manual winding mechanism or a battery-powered motor—both of which have serious disadvantages. With respect to the electrical motor solution, if the battery is depleted, the crossbow cannot be operated until the battery is replaced. With respect to manual winding mechanisms, this option can be very tedious and time-consuming for the user. For example, manual winding mechanisms typically require a significant number of revolutions via a crank handle—for example, between ten and thirty revolutions to fully cock the crossbow. Then, after the shot, the user must repeat the same high number of revolutions in the opposite direction to bring the trigger latch block back to its initial position at the front of the crossbow to reengage the bowstring. After reengaging the bowstring, the user must again repeatedly rotate the crank handle to re-cock the bowstring. This winding and unwinding process is time-consuming and creates a major inconvenience for faster paced activities, such as target shooting and sight-in adjustment.

Accordingly, what is needed is a crossbow with a movable trigger latch block configured to use an improved cocking mechanism that alleviates the amount of effort a user must exert to cock the crossbow, while enabling the user to quickly cock the crossbow and then quickly return the trigger latch block to its initial position, without requiring the user to wind and unwind the cocking mechanism.

BRIEF DESCRIPTION OF THE DRAWING VIEWS

DETAILED DESCRIPTION OF SELECTED EMBODIMENTS

Figure 1:
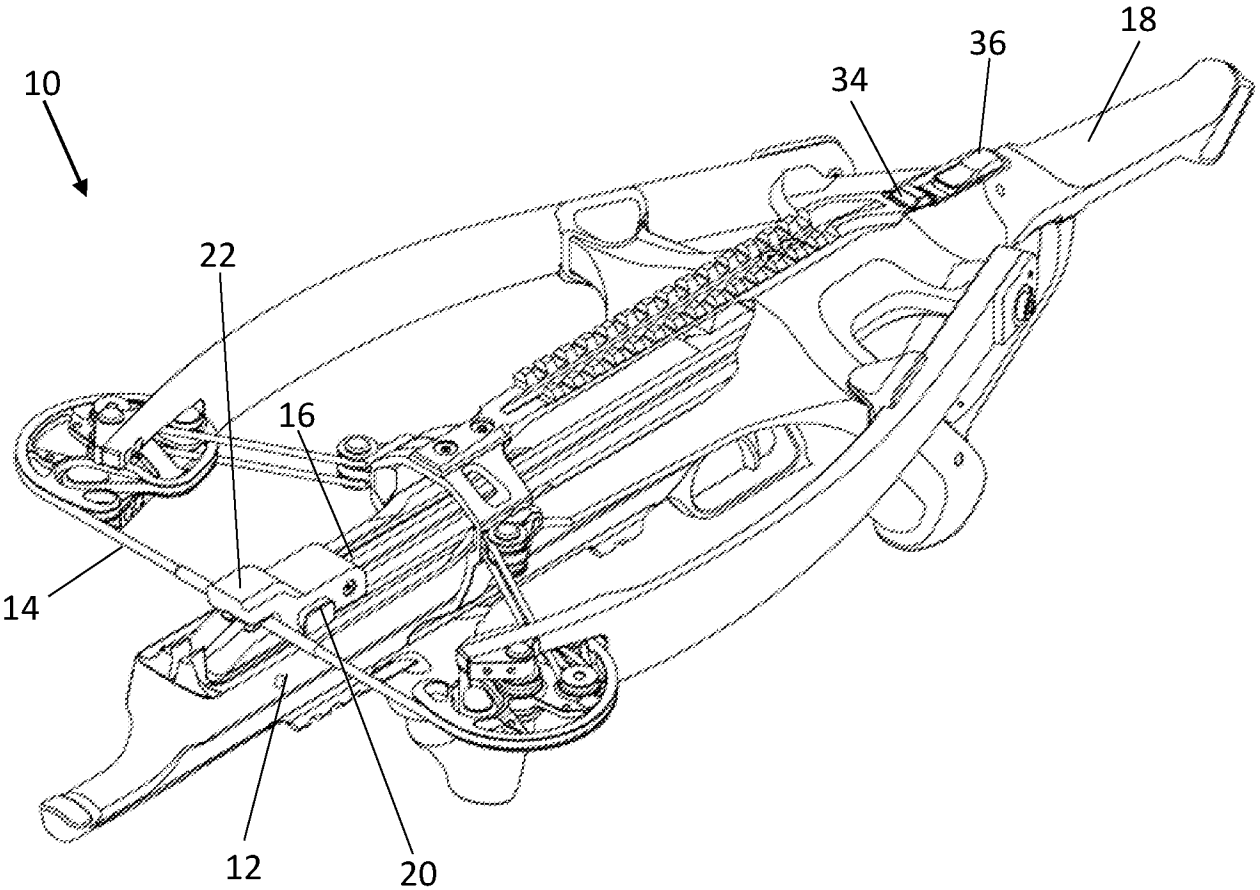
FIG. 1 depicts a perspective view of a trigger-traverse lever action crossbow in a default configuration, with the cocking lever in a fully closed position and the trigger latch block in an initial position at the front of the flight track.

In the following detailed description of the preferred embodiment, reference is made to the accompanying drawings, which form a part hereof, and within which specific embodiments are shown by way of illustration by which the invention may be practiced. It is to be understood that other embodiments may be utilized and structural changes may be made without departing from the scope of the invention.

FIGS. 1-12 depict an embodiment of a trigger-traverse lever action crossbow having a two-stroke cocking mechanism. This two-stroke cocking mechanism provides a significant mechanical advantage over a single-stroke mechanism. Unlike single-stroke cocking mechanisms that require the user to full draw the bowstring with a single rotation of the cocking lever, the novel and nonobvious two-stroke cocking mechanism enables the user to accomplish this task via twice the rotational input from the cocking lever.

The two-stroke cocking mechanism significantly ameliorates the task of cocking the crossbow by reducing the effort load and strength required. The reduction in the amount of required user strength needed to cock the crossbow affords an opportunity for increased crossbow draw weight, increased crossbow draw length, and/or decreased cocking lever size and/or angle of rotation.

In an embodiment, the trigger-traverse crossbow comprises a trigger latch block, a high helix-lead screw, a spring motor, a one-way clutch, cocking hooks, a cocking lever, and a bowstring. The high-helix lead screw is rotationally coupled to the trigger latch block via a thread profile. The spring motor is pre-wound and coupled to one end of the lead screw, and the one-way clutch is coupled to the other end thereof.

In an embodiment, the trigger-traverse mechanism functions in the following manner. Disengaging the one-way clutch releases the high-helix lead screw. The pre-wound/ charged spring motor rotates the lead screw driving the trigger latch block forwards towards the bowstring. The trigger latch block is driven forward towards the resting bowstring, until the bowstring is captured by a latch mechanism of the trigger latch block.

The cocking lever is coupled to the cocking hooks running on both sides of the trigger latch block. Rotating the cocking lever draws the cocking hooks back. This, in turn, draws back the bowstring via the trigger latch block.

As the trigger latch block is pulled back, the high-helix lead screw rotates, winding and charging the spring motor. The one-way clutch prevents the high-helix lead screw from winding back and, therefore, retains the trigger latch block and bowstring in their partially drawn position when the cocking lever is returned for handover.

Once the cocking lever is fully rotated, the bowstring can be held at the halfway point for handover via the trigger latch block, high-helix lead screw, and one-way clutch. Returning the cocking lever to its closed position moves the cocking hooks forward, allowing the second pair of the cocking hooks to re-couple with the trigger latch block in the halfway position.

Rotating the cocking lever a second time repeats the process of drawing the trigger latch block back until the bowstring reaches its fully drawn position. Upon release, the linear travel of the trigger latch block is held for a second time via the lead screw and one-way clutch. The cocking lever is returned to its closed position, moving the cocking hooks forward. The bowstring can then be released from the trigger latch block via a trigger pull. The bowstring returns to its initial resting position, propelling an arrow positioned on the flight track. The user then disengages the one-way clutch from the lead screw, which causes the wound spring motor to rotate the lead screw, thereby bringing the trigger latch block to its initial position at the front of the crossbow.

With reference to FIG. 1, dual-stroke trigger-traverse lever action crossbow 10 includes a body 12 and a bowstring 14 connected thereto. The crossbow body 12 has a top surface 16 (i.e., flight track 16) along which bowstring 14 travels when the crossbow 10 is being cocked and shot.

Figure 2:
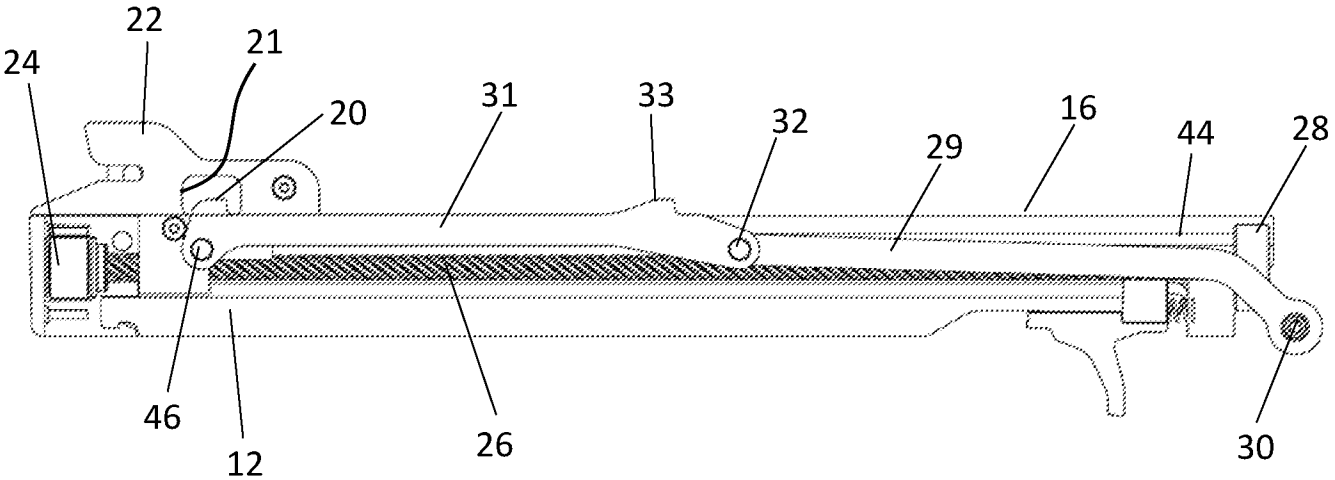
FIG. 2 depicts a side view of the cocking and trigger release mechanisms of the trigger-traverse lever action crossbow in a default configuration, with the cocking lever in a fully closed position.

FIG. 1 shows an initial, un-cocked position of the trigger-traverse crossbow 10. In this initial position, the cocking lever 18 (rear stock) is in its closed position. A first pair of cocking hooks 20 protrude above flight track 16 of the crossbow body 12. The cocking hooks 20 are configured to engage receptacles 21 of the trigger latch block 22, as depicted in FIG. 2. The cocking hooks 20 are configured to move in a rearward direction along flight track 16 when cocking lever 18 is rotated from its closed position. Trigger latch block 22 is configured to engage bowstring 14 and draw the bowstring 14 in the rearward direction with movement of trigger latch block 22.

Figure 3:
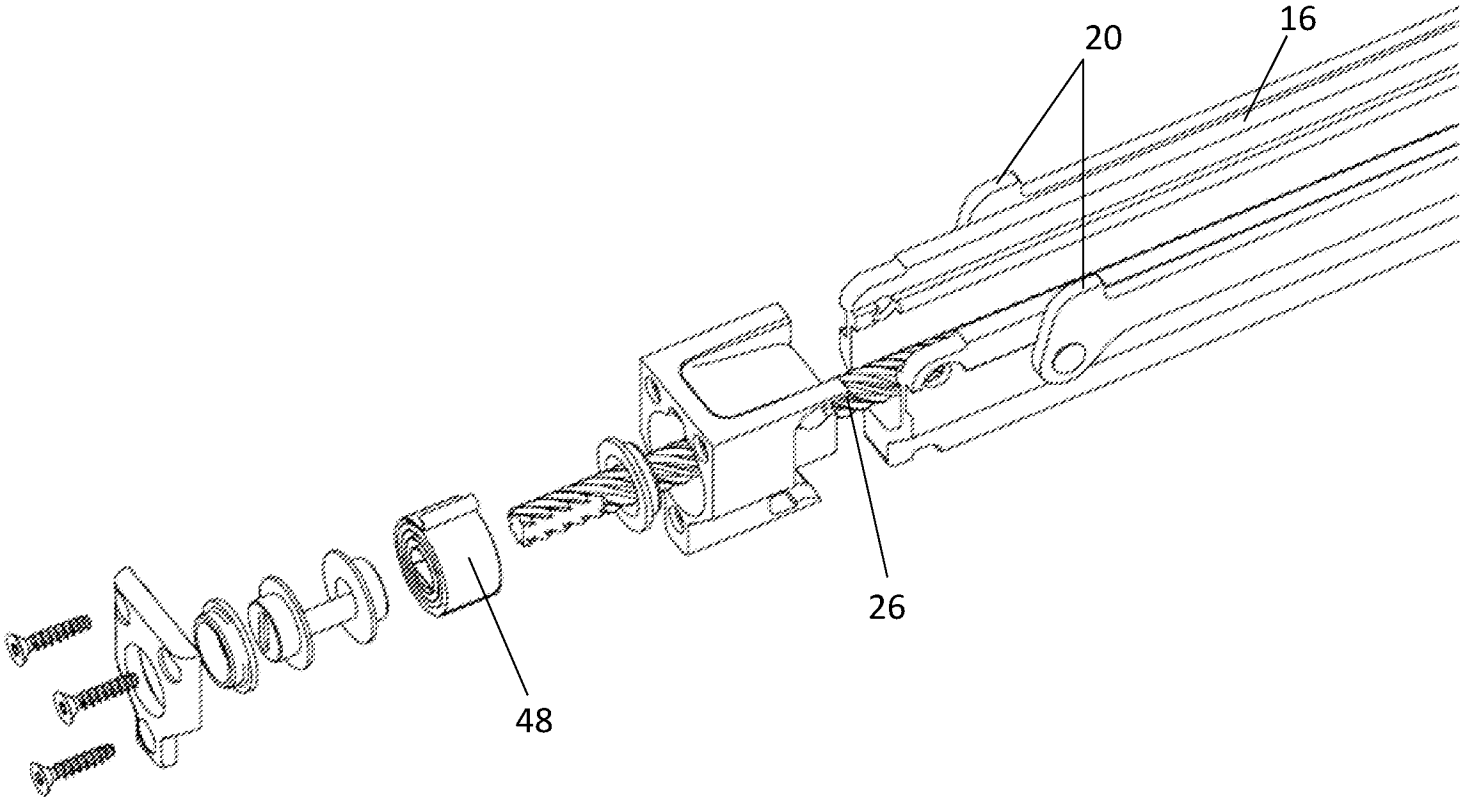
FIG. 3 is an exploded perspective view of the trigger release mechanism.

With reference to FIG. 2, a spring motor 24 is positioned at the front of the crossbow 10. As shown in FIGS. 2 and 3, the spring motor 24 is connected to one end of a helix lead screw 26. A one-way clutch 28 engages the second end of the lead screw 26. When engaged, the one-way clutch 28 enables the lead screw 26 to rotate only in one direction and immobilizes the lead screw 26 against rotation in the opposite direction. In this way, the lead screw 26 and the one-way clutch 28 provide a one-way retention mechanism configured to immobilize the trigger latch block 22 against linear movement in a forward direction along the flight track 16. When the crossbow 10 is being cocked, the trigger latch block 22 travels back along the flight track 16 of the crossbow body 12. As the trigger latch block 22 moves back, it rotates the lead screw 26 about its center axis. This rotation winds and charges the spring motor 24. After the crossbow 10 is fired, the user may press the trigger release button 34 (shown in FIG. 1), which disengages the one-way clutch 28. When the one-way clutch 28 is disengaged, the spring motor 24 unwinds, rotating the lead screw 26, which causes the trigger latch block 22 to move toward its initial position at the front of the crossbow (shown in FIGS. 1 and 2). In this way, the spring motor 24 provides a trigger-traverse mechanism configured to return trigger latch block 22 to its initial position after the bowstring is released.

Referring still to FIG. 2, a rearward end of cocking arm 29 may be pivotally secured to cocking lever 18 via pivot point connection 30, while a forward end of cocking arm 29 may be pivotally secured to cocking link 31 via pivot point connection 32. In certain embodiments, the first cocking hooks 20 are formed at a forward end of cocking link 31 and second cocking hooks 33 are formed near a rearward end of cocking link 31. Crossbow 10 may include a pair of cocking arms 29 and a pair of pivotally connected cocking links 31, with lead screw disposed between the pairs.

With reference again to FIG. 1, a lever-release actuator 36 retains the cocking lever 18 in its closed position. To cock the crossbow 10, the user disengages the lever-release actuator 36, which enables the user to rotate the cocking lever 18.

Figure 4:
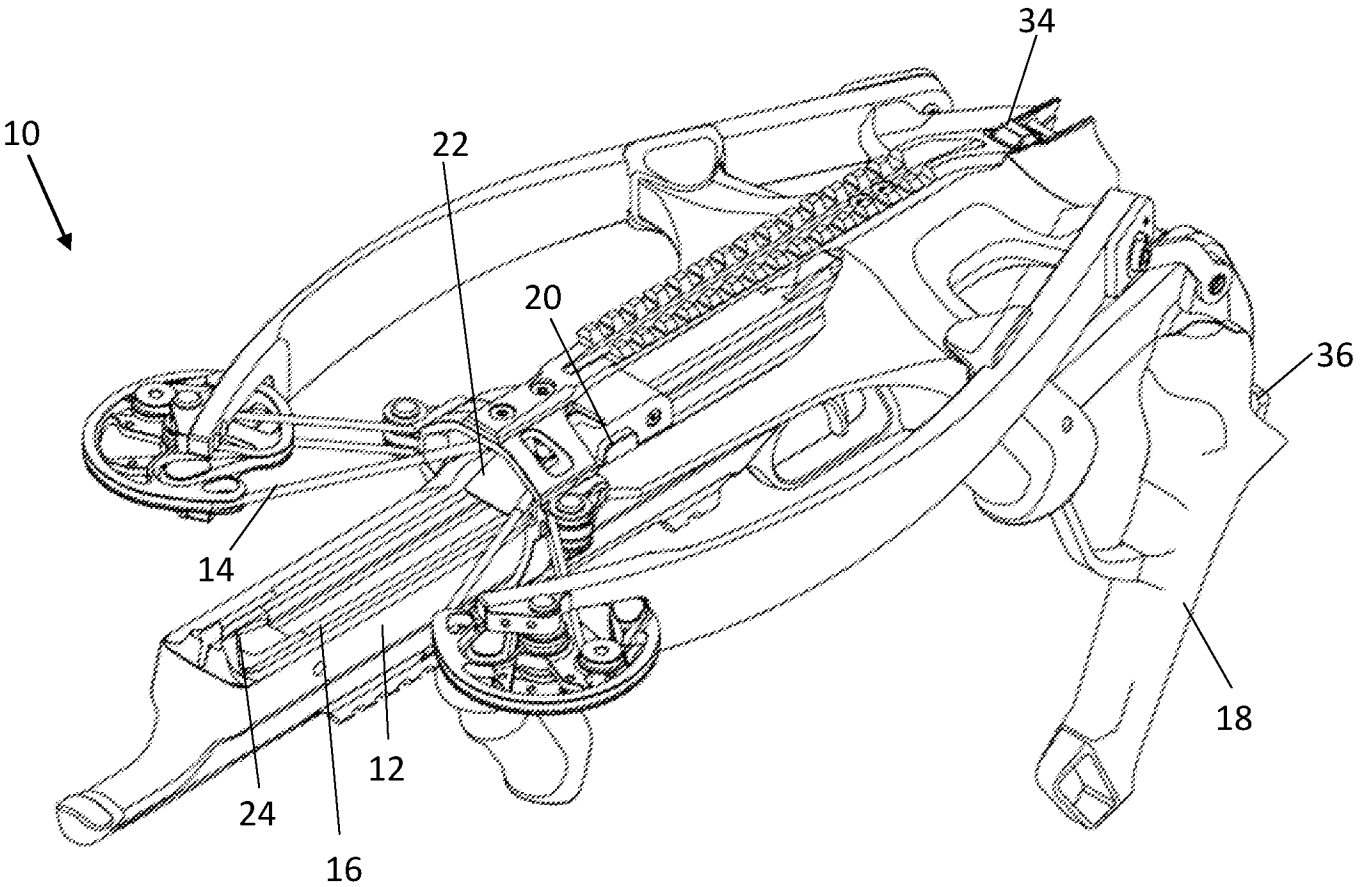
FIG. 4 depicts a perspective view of the trigger-traverse lever action crossbow, with the cocking lever in its fully rotated position. The first pair of the cocking hooks draws the trigger latch block toward its intermediate position along the flight track.

As shown in FIG. 4, the cocking lever 18 may be rotated in a downward direction relative to the body 12 of the crossbow 10. When the cocking lever 18 is rotated away from its closed position, the first cocking hooks 20 travel in a rearward direction along the crossbow body 12, thereby translating the trigger latch block 22 in the rearward direction along the flight track 16 and drawing the bowstring 14 in the rearward direction.

Figure 5:
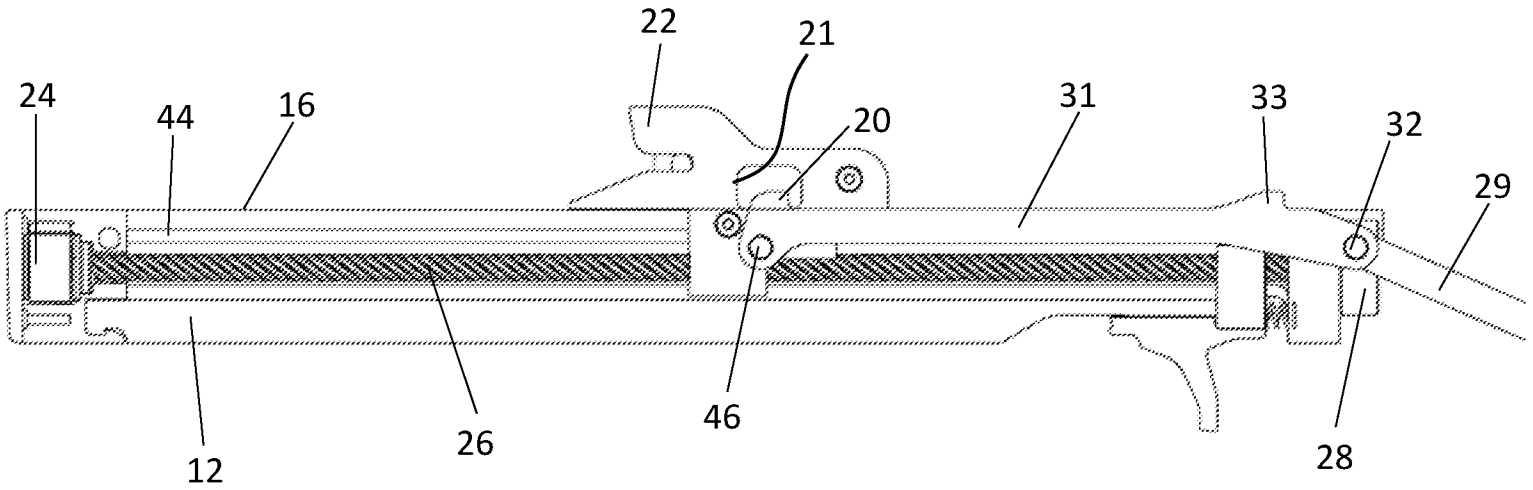
FIG. 5 depicts a side view of the cocking and trigger release mechanisms, with the cocking lever in its fully rotated position. The first pair of the cocking hooks draws the trigger latch block toward its intermediate position along the flight track.

Referring to FIG. 5, as the cocking lever 18 rotates downward, it pulls the cocking arm 29 and the cocking link 31 in the rearward direction relative to the crossbow body 12. As the cocking link 31 moves in the rearward direction, the pair of first cocking hooks 20 engages the trigger latch block 22 and pulls the trigger latch block 22 in the rearward direction, which rotates the helix lead screw 26 in a clockwise direction about a central axis of lead screw 26.

Figure 6:
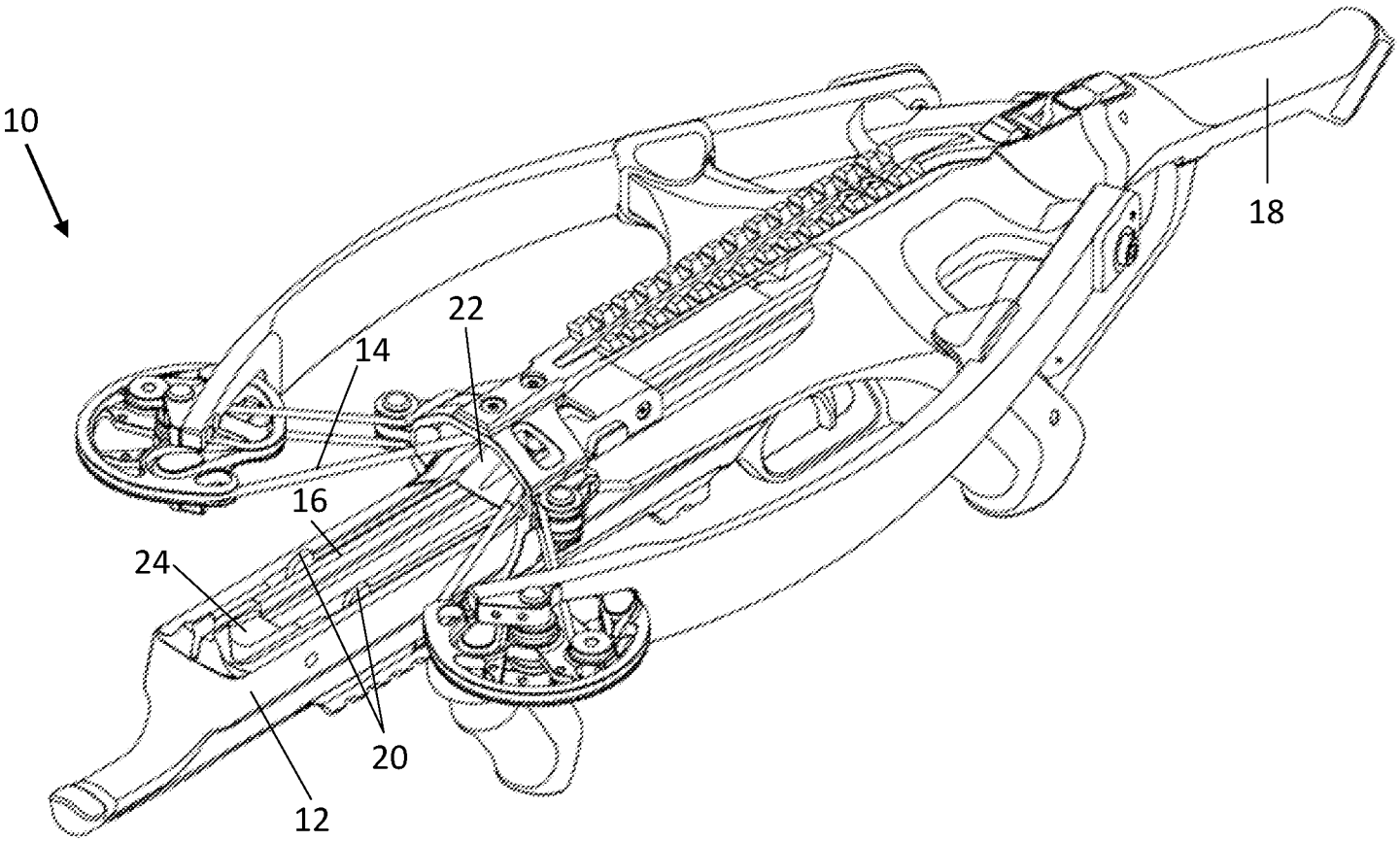
FIG. 6 depicts a perspective view of the trigger-traverse lever action crossbow, with the cocking lever returned to its closed position, and the trigger latch block remaining in its intermediate position.
Figure 7:
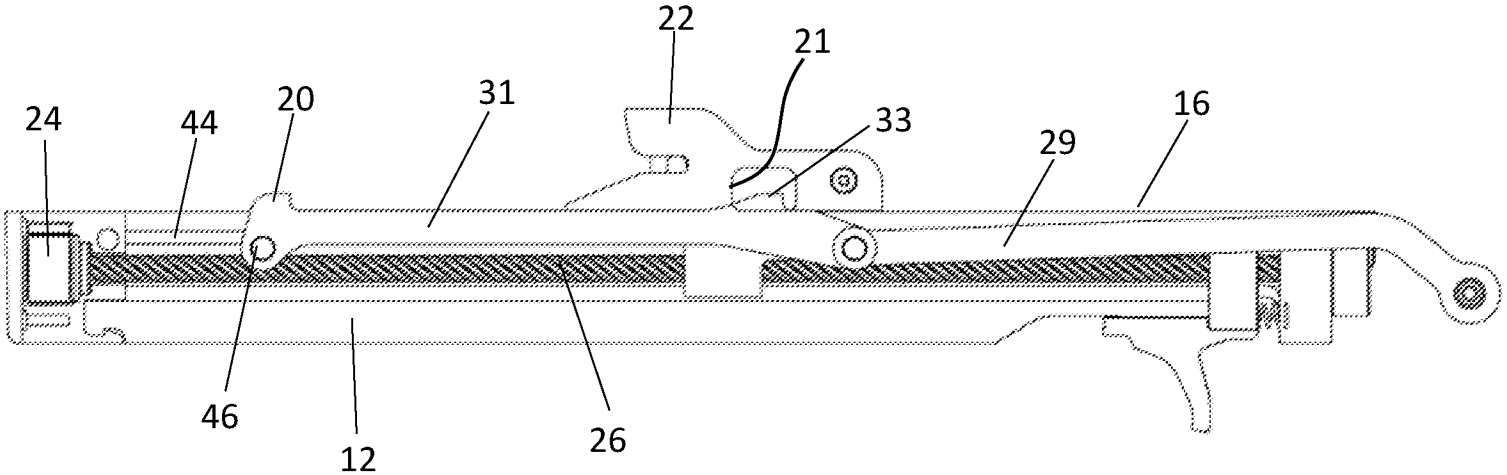
FIG. 7 depicts a side view of the cocking and trigger release mechanisms, with the cocking lever returned to its closed position and the trigger latch block remaining in its intermediate position.

With reference to FIGS. 6 and 7, returning the cocking lever 18 to its initial closed position completes a first cocking stroke. As the cocking lever 18 is returned to its closed position, the cocking arm 29 and the cocking link 31 move in a forward direction to return to their initial positions. After the first cocking stroke, the trigger latch block 22 is positioned in a midsection of the crossbow body 12. Because the one-way clutch 28 immobilizes the lead screw 26 against counterclockwise rotation, the trigger latch block 22 remains stationary at the midsection of the crossbow body 12. When the cocking arm 29 and the cocking link 31 return to their initial positions, the pair of second cocking hooks 33 engages the receptacles 21 of trigger latch block 22. At this point, the crossbow 10 is ready for the second cocking stroke.

Figure 8:
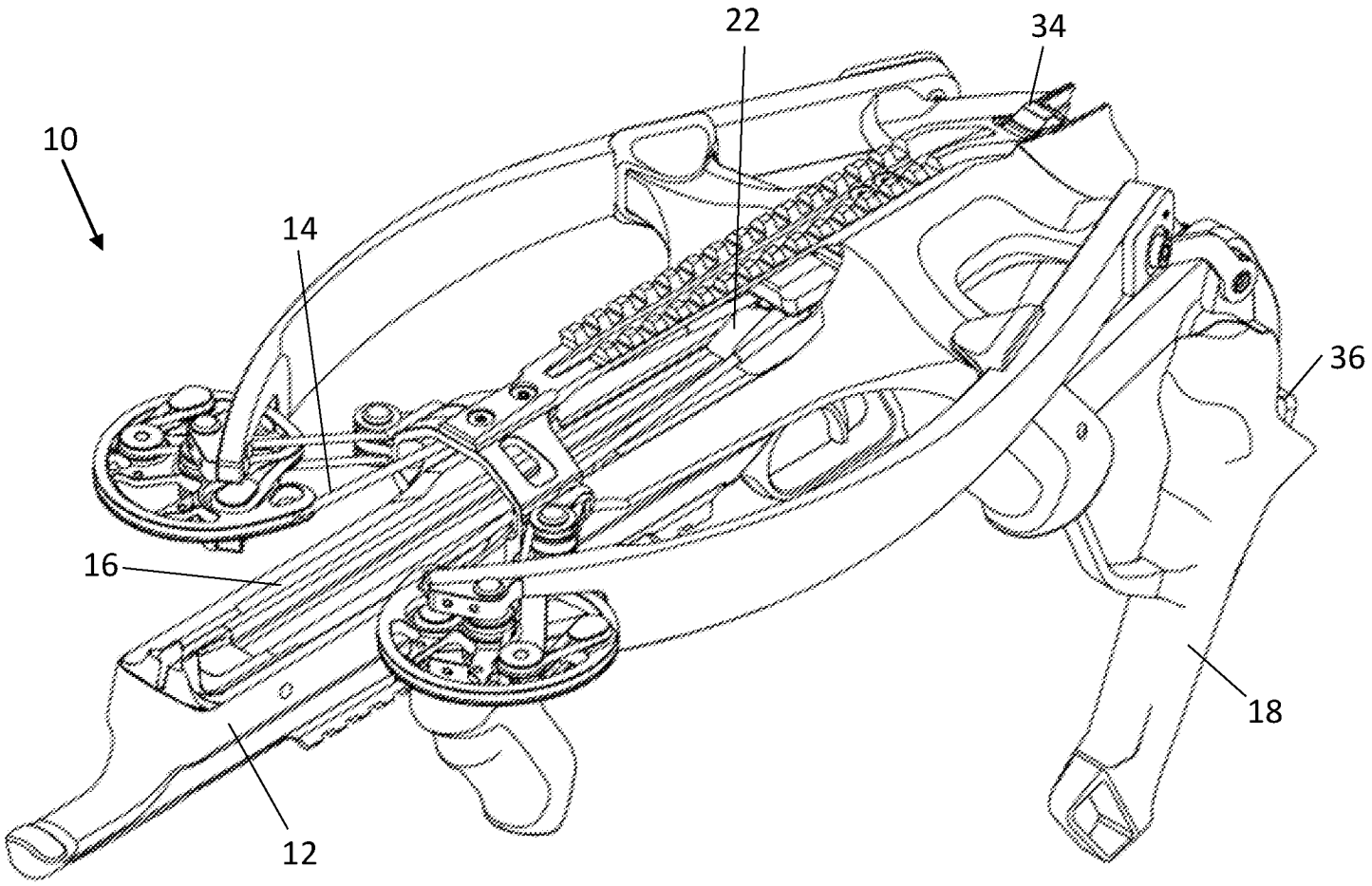
FIG. 8 depicts a perspective view of the trigger-traverse lever action crossbow, with the cocking lever in its fully rotated position, and the trigger latch block being drawn toward its cocked position by the second pair of the cocking hooks.
Figure 9:
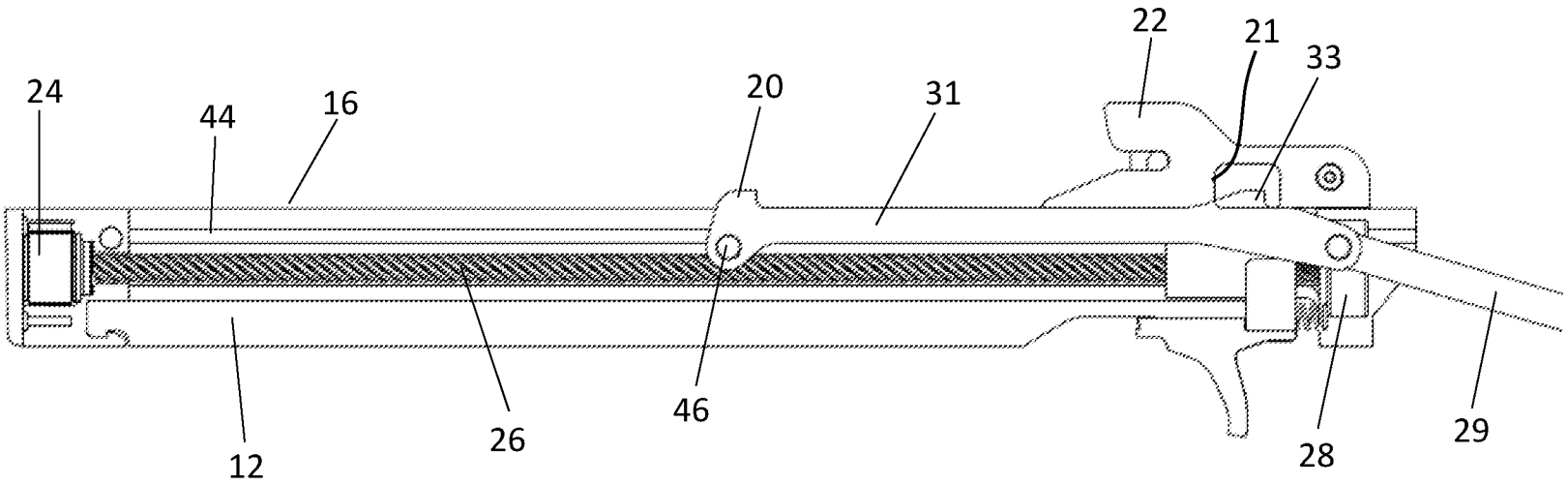
FIG. 9 depicts a side view of the cocking and trigger release mechanisms, with the cocking lever in its fully rotated position, and the trigger latch block being drawn toward its cocked position by the second pair of the cocking hooks.

FIGS. 8-11 depict the second stroke of the cocking lever. FIGS. 8 and 9 show that as the cocking lever 18 rotates downward relative the crossbow body 12, the pair of second cocking hooks 33 engages the receptacle 21 of trigger latch block 22 and draws the trigger latch block 22 rearward toward the trigger assembly of the crossbow 10. As the trigger latch block 22 moves rearward relative to the flight track 16, the trigger latch block 22 rotates the helix lead screw 26 in a clockwise direction, further winding and charging the spring motor 24. FIGS. 8 and 9 show the trigger latch block 22 and bowstring 14 in the fully cocked position.

Figure 10:
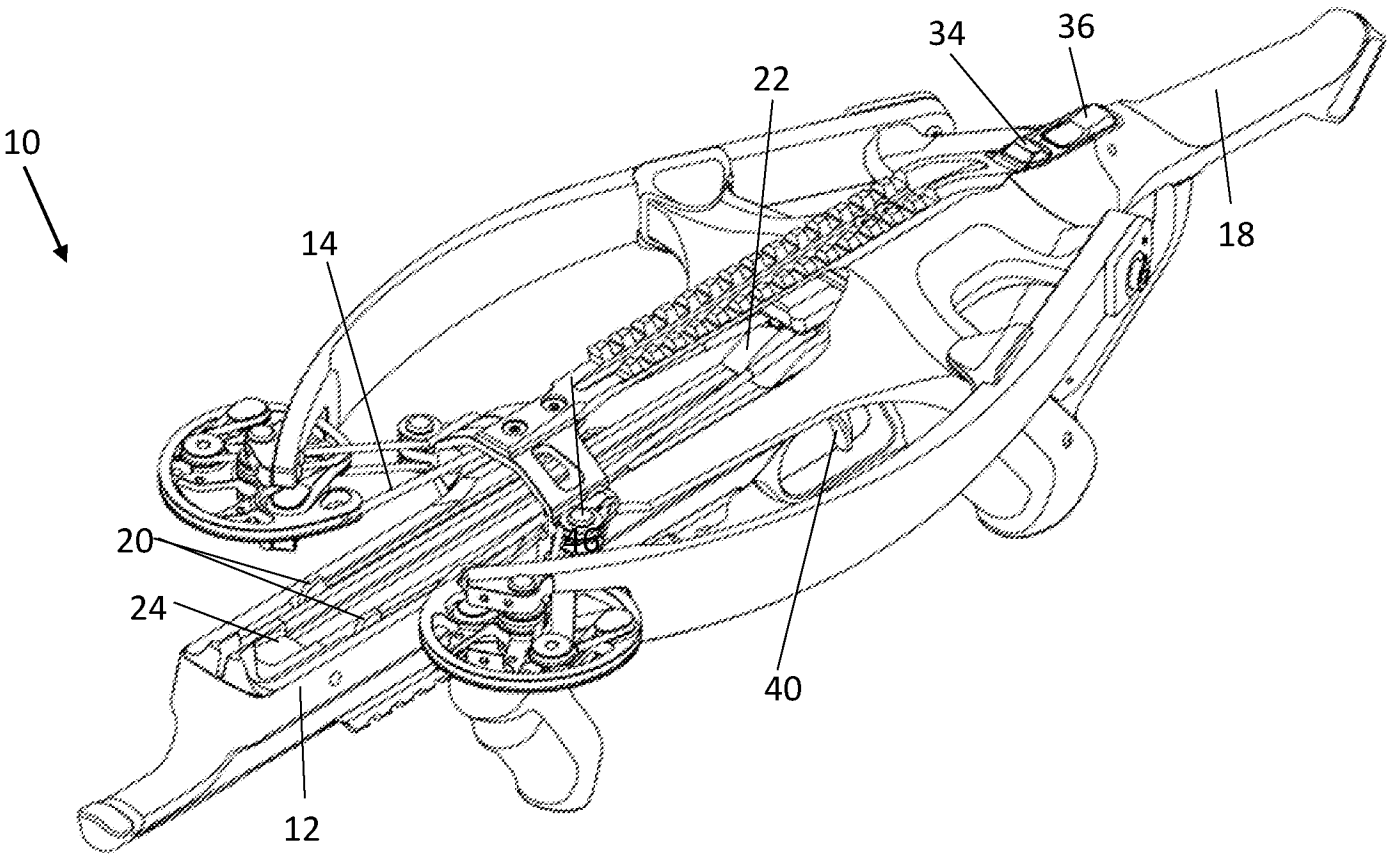
FIG. 10 depicts a perspective view of the trigger-traverse lever action crossbow, with the cocking lever returned to its closed position, and the trigger latch block remaining in its cocked position.
Figure 11:
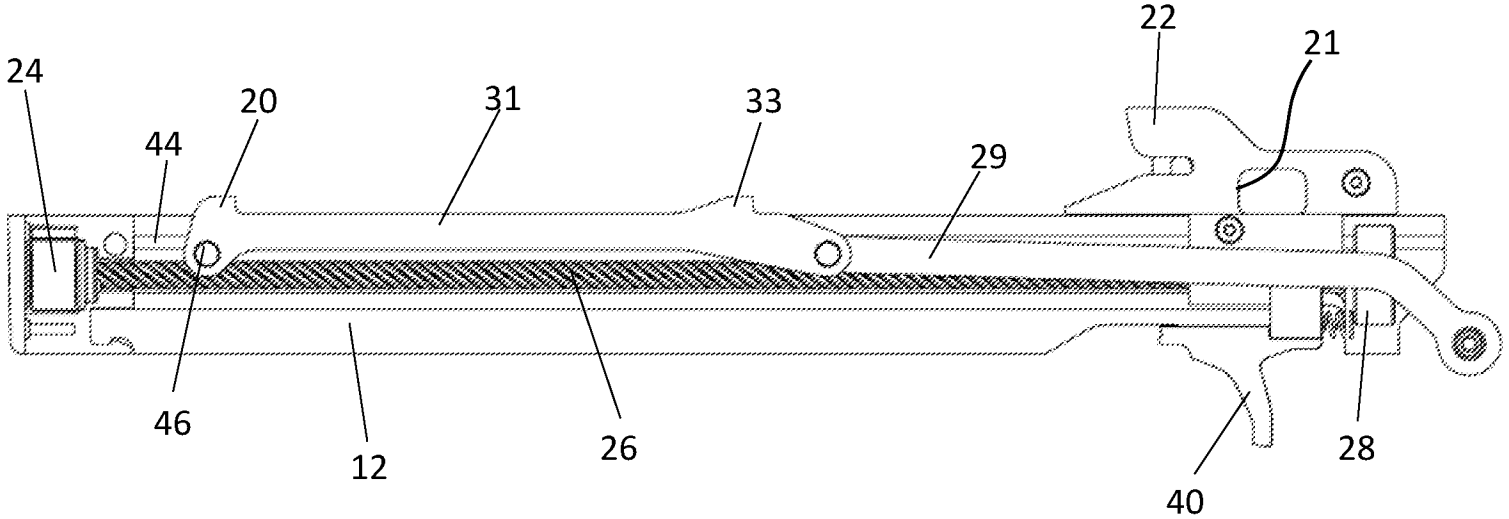
FIG. 11 depicts a side view of the cocking and trigger release mechanisms, with the cocking lever returned to its closed position, and the trigger latch block remaining in its cocked position.
Figure 12:
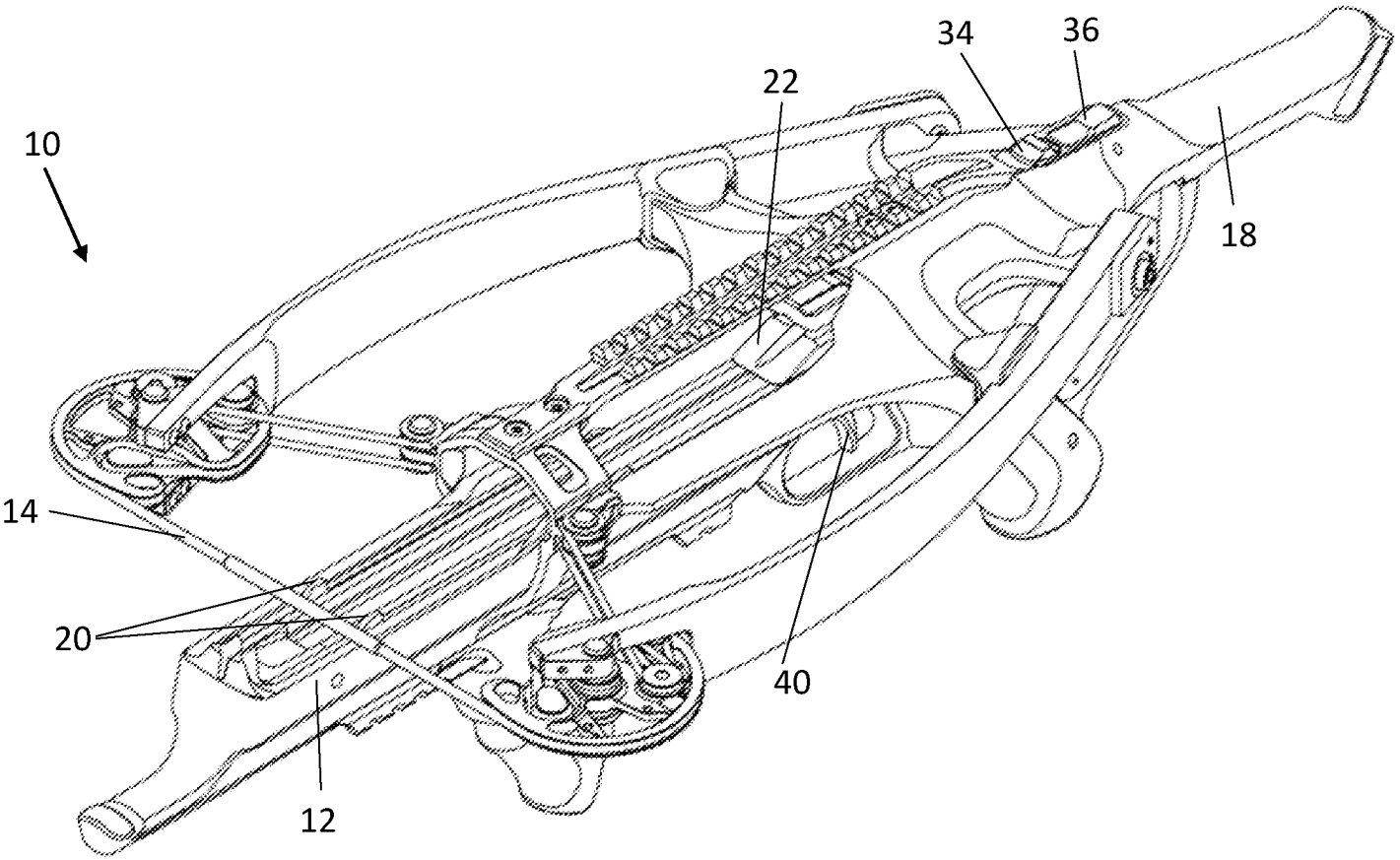
FIG. 12 depicts a perspective view of the trigger-traverse lever action crossbow, after the trigger pull releases the bowstring from the trigger latch block, and the trigger latch block remains in its fully drawn position.

FIGS. 10 and 11 show the cocking lever 18 returned to its closed position and the cocking hooks 20 and 33 returned to their initial default positions. At this point, the crossbow 10 is ready to be fired. The user may load an arrow onto the flight track 16 and pull the trigger 40. FIG. 12 illustrates the configuration of crossbow 10 after the bowstring 14 is released from the trigger assembly. In this configuration, the bowstring 14 returns to its initial resting position, while the trigger latch block 22 remains in the rearward position along the flight track 16.

To return the trigger latch block 22 to its default position at the front end of the crossbow 10, the user may press the trigger release button 34. The trigger release button 34 disengages the one-way clutch 28 from the helix lead screw 26, enabling the lead screw 26 to rotate in a counterclockwise direction about the central axis of the lead screw 26 in response to the spring tension of the spring motor 24. The counterclockwise rotation of the lead screw 26 brings the trigger latch block 22 to the front of the crossbow 10, into the position shown in FIGS. 1 and 2. At this point, the crossbow 10 is ready for the next two-stroke cocking cycle.

With reference to FIGS. 2, 5, 7, 9, and 11, one embodiment of the crossbow body 12 includes a longitudinal groove 44 in the lateral side of the body 12. The cocking link 31 has a set of pins 46 residing within the longitudinal groove 44, enabling the cocking link 31—and, therefore, the pairs of first and second cocking hooks 20 and 33—to slide along the body 12 of the crossbow 10. The cocking link 31 is pivotally connected to the cocking arm 29, which, in turn, is pivotally connected to the cocking lever 18. In this manner, downward rotation of the cocking lever 18 causes the cocking link 31 to slide in the rearward direction relative to the crossbow body 12, and the upward rotation of the cocking lever 18 causes the cocking link 31 to slide in a forward direction relative to the crossbow body 12.

FIG. 3 shows an exploded view of the spring motor 24 and the helix lead screw 26. The lead screw 26 has a steep, high-helix thread pitch in the range of 10 to 25 mm, or greater. The steep, high-helix thread pitch enables the trigger latch block 22 to rotate the lead screw 26 when the trigger latch block 22 is pulled in the rearward direction by the cocking hooks 20 and 33. The linear travel of the trigger latch block 22 winds the lead screw 26 for the purpose of charging a spring 48 and/or any other elastic motor. Once the crossbow 10 is cocked, the loaded bowstring 14 is released, and the one-way clutch 28 is disengaged, the charged spring motor 24 rotates the lead screw 26, which swiftly drives the trigger latch block 22 back to its initial position, in one singular motion. This trigger latch block 22 return mechanism requires little to no effort by the operator. As explained above, the charging of the spring motor 24 is achieved automatically when the trigger latch block 22 is drawn in the rearward direction relative to the crossbow body 12, due to the lever action cocking with cocking lever 18. In this way, the trigger latch block mechanism further reduces the operator's time and effort spent on the crossbow cocking process and process of returning the trigger latch block 22 to its initial position, thus providing greater convenience to the operator during use.

As explained above, some prior art movable trigger latch crossbows have a cocking mechanism that requires the user to repeatedly rotate a crank handle to linearly translate the trigger latch block along the crossbow body. Unlike the present invention, these types of movable trigger latch mechanisms use a low thread pitch lead screw—i.e., less than 10 mm. A key differentiating factor between low and high helix thread pitch lead screws is that a low helix thread can drive high loads via rotational input but cannot be linearly overridden due to the shallow pitch. Thus, when a low pitch helix lead screw is employed, the trigger block latch cannot slide relative to the crossbow body in response to a linear directional force. In sharp contrast, a high-pitch helix thread lead screw used in the present invention can be overridden via a linear force—i.e., moving a lead screw nut (integrated into the trigger latch block 22) along the thread of the lead screw 26 causes the lead screw 26 to rotate. In other words, prior art movable trigger latch mechanisms require that the user rotate the lead screw to linearly translate the trigger latch block. By contrast, in the present invention, the cocking hooks apply a linear force to move the trigger latch block toward the cocked position, and then, the spring motor rotates the high-pitch lead screw to bring the trigger latch block to its initial position at the front of the flight track.

The trigger-traverse mechanism disclosed herein utilizes a power spring and high helix lead screw to drive the trigger latch block towards the bowstring upon actuation of a release switch. This drastically reduces the operator's effort and reduces human error. Furthermore, because the user does not need to have physical access to the trigger latch block as it travels along the flight track, this structural configuration affords an opportunity for alternative designs of the crossbow, including introduction of "bridges" that cross over the flight track for an alternate cam design, as well as various cable and scope rail configurations.

In the embodiment described above, the crossbow has a two-stroke design, which draws the trigger latch block back to the fully drawn position in two full cocking lever rotations. In an alternate embodiment, the crossbow can be configured to use more than two strokes to cock the crossbow—for example, 3, 4, or up to 10 cocking stages/strokes to provide greater mechanical advantage for the operator. In other alternate embodiments, the crossbow can be configured to one stroke to cock the crossbow with only a single pair of cocking hooks. In still other alternate embodiments, the crossbow can use other cocking mechanisms besides a cocking lever and cocking hooks.

In the embodiment shown in FIGS. 1-12, the multi-stage cocking mechanism and the trigger-traverse mechanism are integrated into a pistol format crossbow. However, in another embodiment, these mechanisms can be integrated into larger full-size crossbows of varied styles and specifications.

In the embodiment shown in FIGS. 1-12, the cocking lever is in the form of a break action lever at the rear of the stock. However, in alternate embodiments, the cocking lever can be located in a different position relative to the crossbow body—for example, an under lever or a side lever may be used to cock the crossbow in a similar manner.

In the embodiment depicted in FIGS. 1-12, the handover position for the trigger latch block 22 is at the halfway point along the flight track 16. However, in alternate embodiments, the handover point could be located in any position along the draw stroke length of the track.

In the embodiment shown in FIGS. 1-12, the trigger-traverse mechanism is driven by a power spring. However, in alternate embodiments, the mechanism could be driven by a constant force spring, torsion spring, tension spring, compression spring, elasticated bungee, elasticated tape, or battery powered DC motor to achieve the same result of driving the trigger latch block.

In the embodiment shown in FIGS. 1-12, the linear travel of the trigger latch block 22 charges the drive mechanism via a high-helix lead screw 26. In an alternate embodiment, the drive mechanism could be charged via a toothed belt loop and gear, toothed rack and gear, flat belt and spool, or corded line and spool to achieve the same result of charging the drive mechanism.

In the embodiment shown in FIGS. 1-12, the linear travel of the trigger latch block 22 is held and prevented from reversing via a one-way spring-loaded clutch 28. In an alternative embodiment, this function can be achieved via a one-way dog clutch, one-way friction clutch, ratchet and pawl, one, two or more spring-loaded plungers and catches, or one, two or more spring-loaded latch hooks and catches.

In the embodiment shown in FIGS. 1-12, the cocking mechanism of crossbow 10 includes a cocking lever, a pair of first cocking hooks, and a pair of second cocking hooks. In alternate embodiments, the trigger-traverse mechanism disclosed herein may be included in crossbows having other cocking mechanisms. For example, the trigger-traverse crossbow may use a crank cocking device, a rope cocking device, or any other cocking device.

Figure 13:
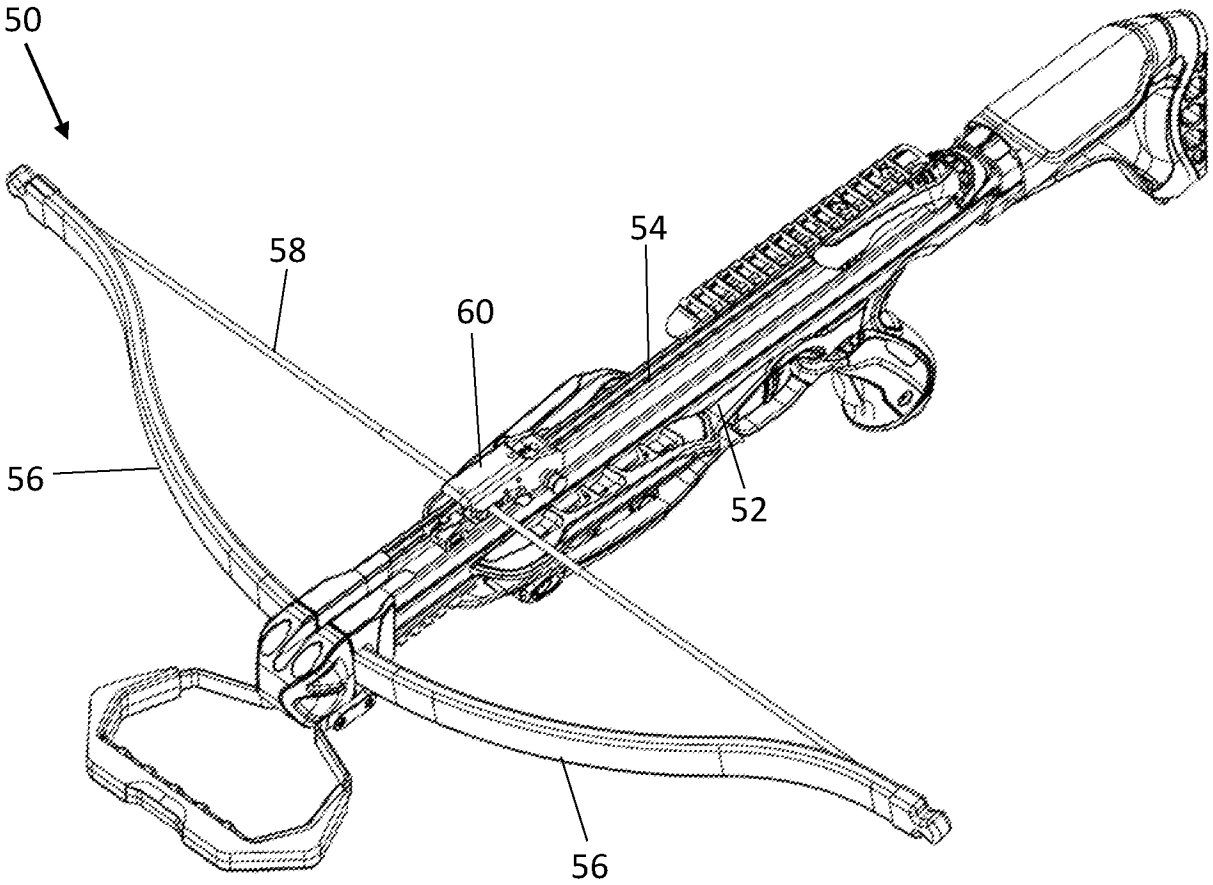
FIG. 13 is a perspective view of an alternate trigger-traverse crossbow.

FIG. 13 illustrates an alternate embodiment of the trigger-traverse crossbow including the trigger-traverse mechanism disclosed herein. Trigger-traverse crossbow 50 includes body 52 with flight rail 54. Limbs 56 extend outward from a forward end of body 52 with bowstring 58 extending between the outer portions of limbs 56. Crossbow 58 also includes trigger latch block 60 slidingly connected to body 52, a one-way retention mechanism configured to prevent forward movement of trigger latch block 60 along flight rail 54 until a trigger release is activated, and a trigger-traverse mechanism. The trigger latch block 60 may engage the bowstring 58 at the forward end of the crossbow. The trigger latch block 60 may be drawn in a rearward direction along flight rail 54 using any cocking mechanism. As trigger latch block 60 moves in the rearward direction, it draws bowstring 58 in the rearward direction from the initial position shown in FIG. 13 into a cocked position. After the bowstring 58 is released with activation of the trigger, the user may activate the trigger release to disengage the one-way retention mechanism, thereby allowing the trigger-traverse mechanism to draw trigger latch block 60 in the forward direction toward the forward end of the crossbow 50. In one embodiment, the one-way retention mechanism of crossbow 50 includes a helix lead screw threadedly engaging the trigger latch block, with the helix lead screw engaging a spring motor on one end and engaging a one-way clutch on the second end.

Figure 14:
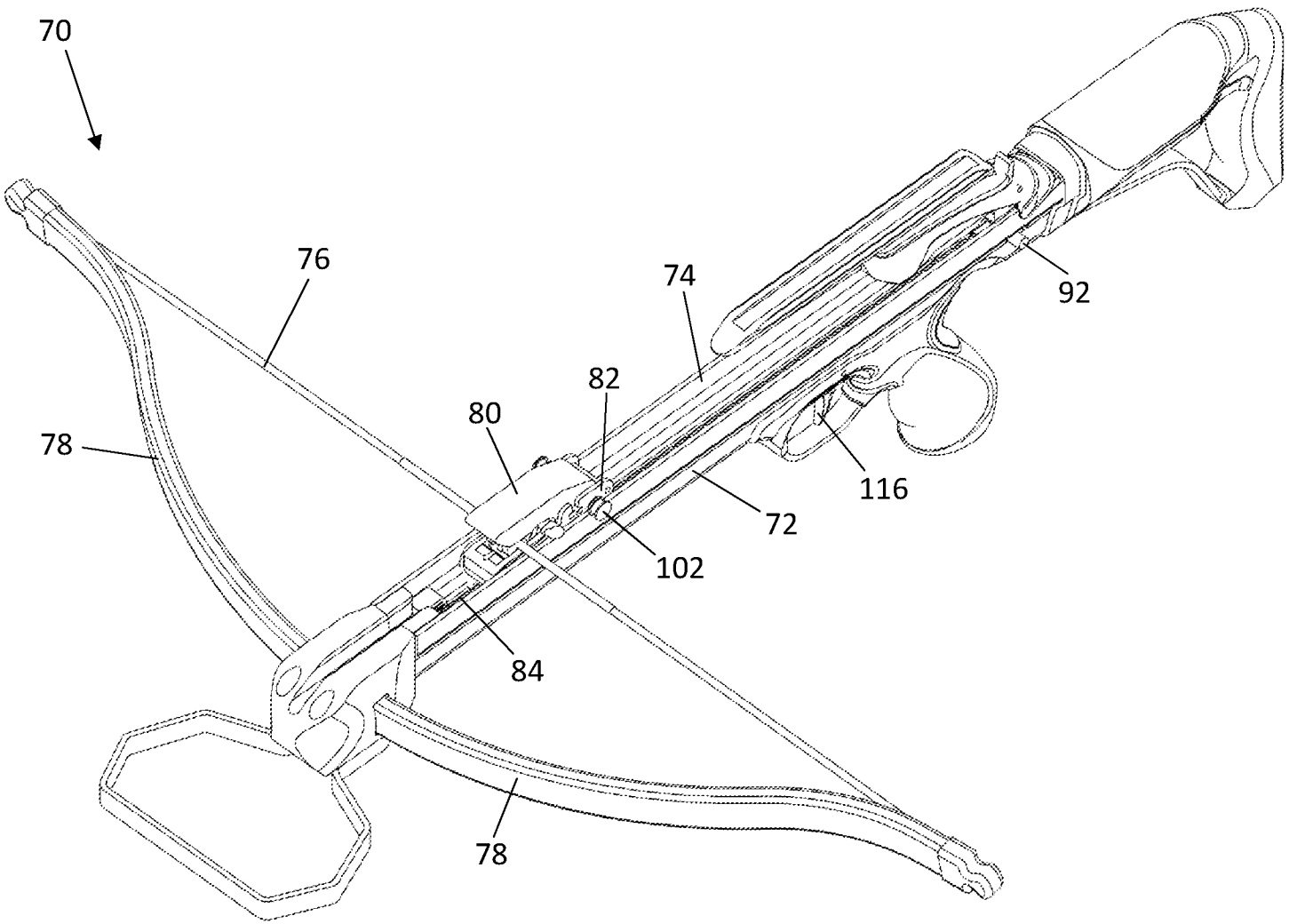
FIG. 14 is a perspective view of another alternate trigger-traverse crossbow in a default configuration with a trigger latch block in an initial position at the front of the flight track.

FIG. 14 illustrates another alternate embodiment of the trigger-traverse crossbow disclosed herein in a default configuration. Trigger-traverse crossbow 70 includes body 72 having flight track 74 (also referred to as flight rail). Bowstring 76 is coupled to body 72 with limbs 78 such that bowstring 76 extends across flight track 74. Crossbow 70 also includes trigger latch block 80 and hook frame 82, which are both slidingly connected to body 72. In FIG. 14, trigger latch block 80 is in its initial position near a forward end of flight track 74. Trigger latch block 80 is configured to be drawn in a rearward direction along body 72 and flight track 74 from an initial position shown in FIG. 14 to a cocked position (shown in FIGS. 19-21) in response to a rearward draw force. Hook frame 82 engages trigger latch block 80 in a configuration allowing hook frame 82 to transfer a rearward force applied on hook frame 82 to trigger latch block 80 to provide the rearward draw force, which draws trigger latch block 80 in the rearward direction. Trigger latch block 80 is configured to selectively retain bowstring 80 such that rearward movement of trigger latch block 80 draws bowstring 76 in the rearward direction.

Figure 15:
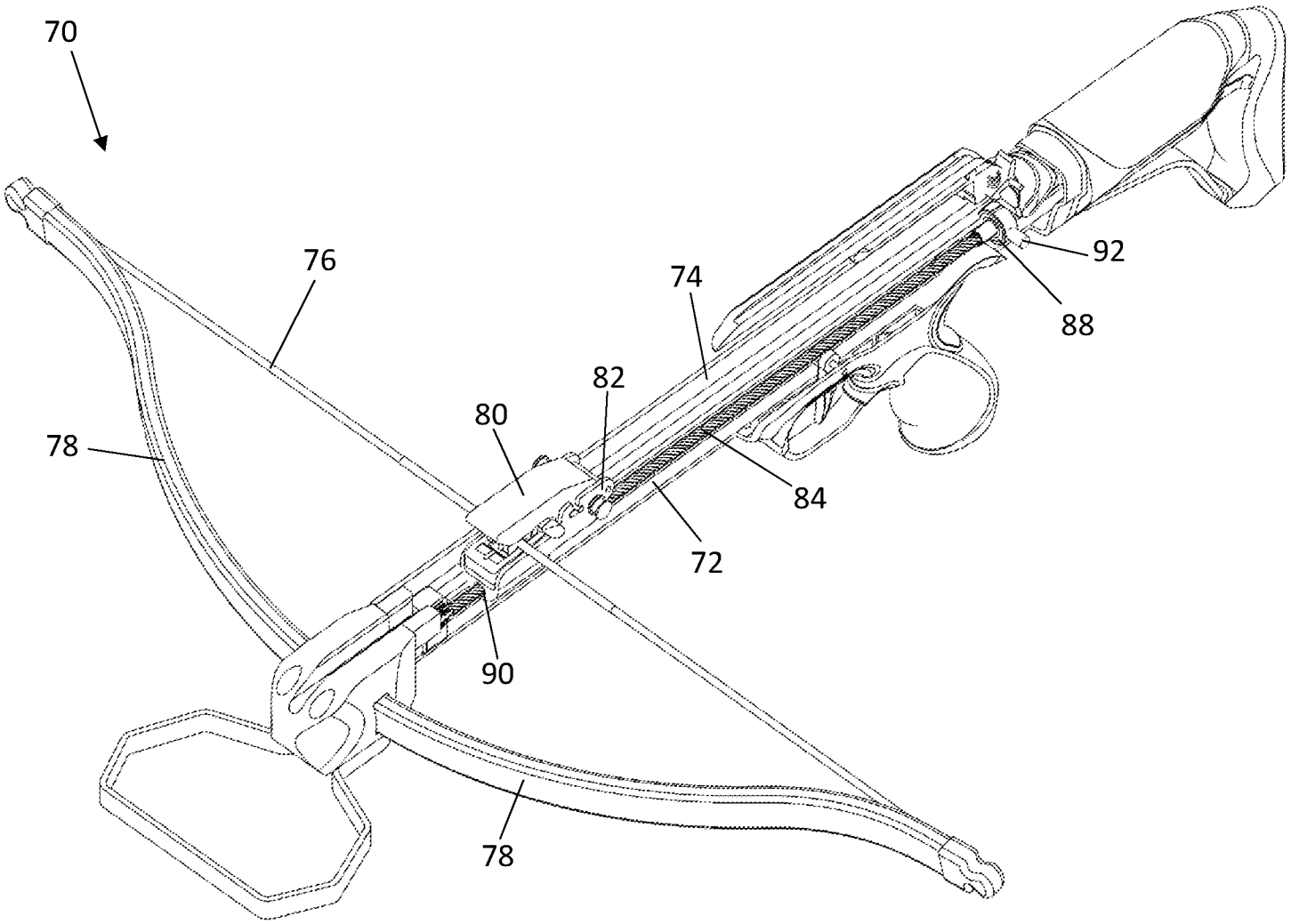
FIG. 15 is a partial cutaway perspective view of the trigger-traverse crossbow of FIG. 14.
Figure 16:
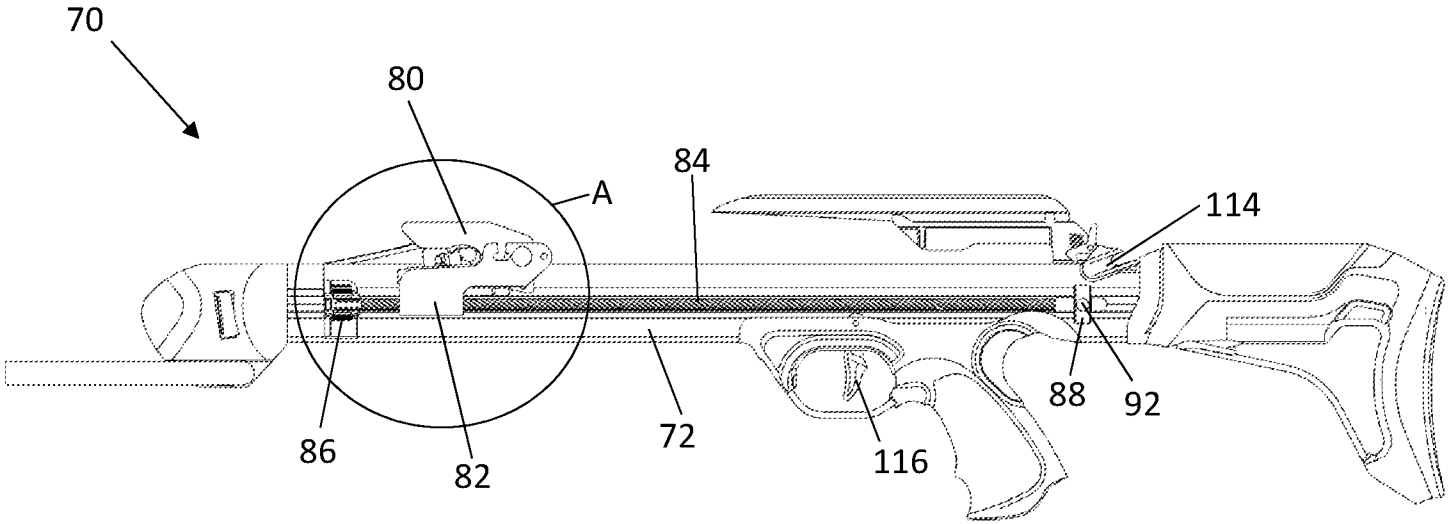
FIG. 16 is a partial cutaway side view of the trigger-traverse crossbow of FIG. 14.

With reference to FIGS. 15-16, crossbow 70 includes helix lead screw 84 extending along crossbow body 72, spring 86, and one-way clutch 88. Helix lead screw 84 is a guide that engages trigger latch block 80 to direct the movement of trigger latch block 80 along crossbow body 72. In the illustrated embodiment, spring 86 engages a forward end of helix lead screw 84, and one-way clutch 88 selectively engages a rearward end of helix lead screw 84. In other embodiments, the trigger-traverse mechanism and the one-way retention mechanism may engage helix lead screw 84 at various points along its length.

Helix lead screw 84 may threadedly engage bore 90 extending through a lower portion of trigger latch block 80 or a lower portion of hook frame 82. Helix lead screw 84 may have a steep, high helix thread pitch. Rearward movement of trigger latch block 80 rotates helix lead screw 84 about a central axis of lead screw 84. For example, helix lead screw 84 is rotated in a clockwise direction about its central axis in response to rearward movement of trigger latch block 80. Spring 86 is configured to be charged by the rotation of helix lead screw 84 caused by the rearward movement of trigger latch block 80. For example, spring 86 may be a clock spring that is wound by this rotation of helix lead screw 84.

One-way clutch 88 selectively engages helix lead screw 84. When engaged, one-way clutch 88 is coupled to helix lead screw 84 in a manner that allows helix lead screw 84 to rotate only in the direction associated with rearward movement of trigger latch block 80 and immobilizes helix lead screw 84 against rotation in the opposite direction. Activation of clutch release 92 disengages one-way clutch 88 by decoupling one-way clutch 88 from helix lead screw 84, thereby allowing helix lead screw 84 to rotate in both rotational directions. In this way, one-way clutch 88 is a one-way retention mechanism that utilizes helix lead screw 84 to immobilize and selectively retain trigger latch block 80 against linear movement in a forward direction along flight track 74. Spring 86 applies a rotational force on helix lead screw 84 in the direction associated with forward movement of trigger latch block 80. However, when activated, one-way clutch 88 prevents rotation of helix lead screw 84 in response to this rotation force applied by spring 86. When clutch release 92 is activated and helix lead screw 84 is free to rotate in the direction associated with forward movement of trigger latch block 80, the rotational force that spring 86 applies on helix lead screw 84 causes helix lead screw 84 to rotate in a manner that causes trigger latch block 80 to move in the forward direction. In this way, spring 86 is a trigger-traverse mechanism that selectively and automatically moves trigger latch block 80 in the forward direction along flight track 74 from the cocked position to the initial position in response to activation of clutch release 92. In other embodiments, the trigger-traverse mechanism includes a mechanical or electrical component configured to move trigger latch block 80 in the forward direction along flight track 74. In some embodiments, the trigger-traverse mechanism is also configured to selectively and automatically move trigger latch block 80 in the forward direction from any position along flight track 74 to the initial position in response to activation of clutch release 92.

Figure 17:
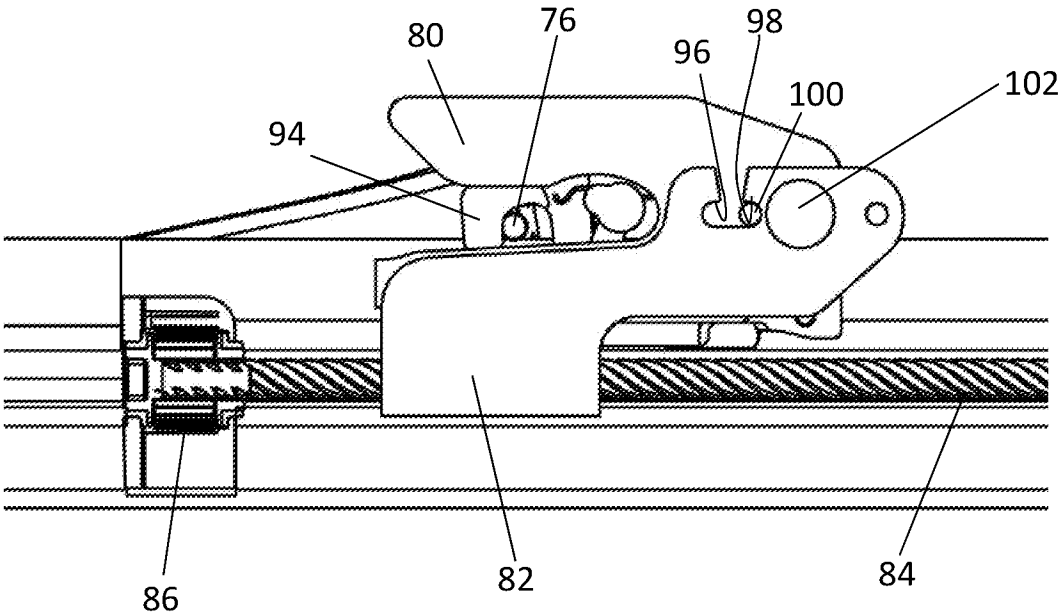
FIG. 17 is a detail view taken from section A in FIG. 16.

As illustrated in FIG. 17, trigger latch block 80 may include latch mechanism 94 configured to selectively retain bowstring 76. In one embodiment, latch mechanism 94 may be a pivotally connected projection extending into a space below an upper portion of trigger latch block 80. Hook frame 82 may include two side walls each extending along one trigger latch block 80. In one embodiment, each side wall of hook frame 82 may include a slot including forward hook projection surface 96 and rearward hook projection surface 98. Hook projection surfaces 96, 98 may be configured to receive and engage lateral projection 100 on each side of trigger latch block 80. Hook frame 82 may also include projections 102 disposed on each of its sides. In one embodiment, projections 102 may be configured to be engaged by a flexible line of a cocking device. In this way, hook frame 82 is configured to transfer a rearward force applied on projections 102 on both sides of hook frame 82 onto trigger latch block 80 through surfaces 96 and lateral projections 100 on both sides.

Figure 18:
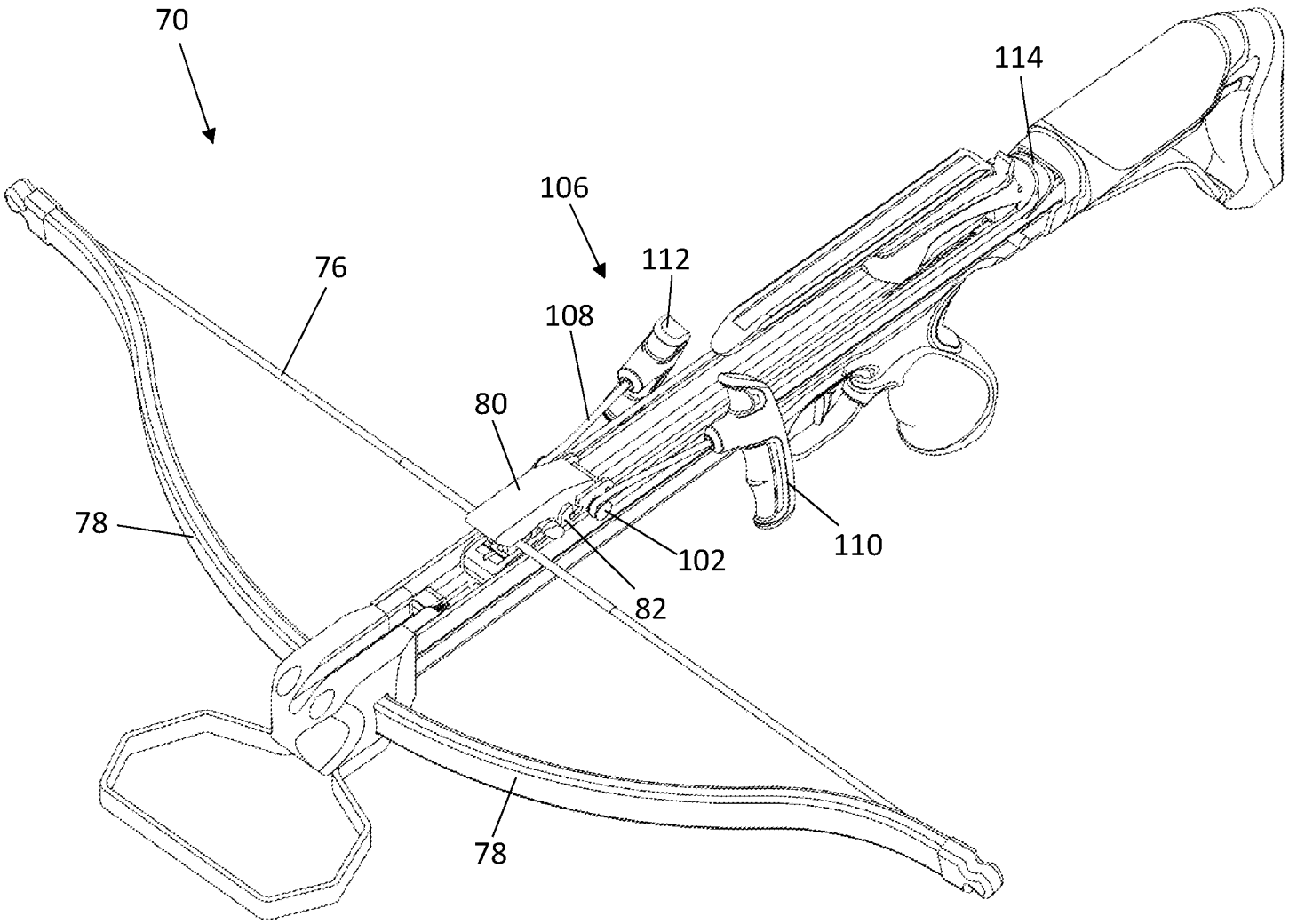
FIG. 18 is a perspective view of the trigger-traverse crossbow of FIG. 14 with a cocking device engaging a hook frame.

Referring now to FIG. 18, cocking device 106 may be attached to crossbow 70 with trigger latch block 80 in the initial position. Cocking device 106 may include flexible line 108 with handle 110 secured to a first end of flexible line 108 and handle 112 secured to a second end of flexible line 108. Flexible line 108 may comprise a rope, string, cord, cable, or any other flexible linear member having a strength sufficient to apply the rearward force necessary to draw trigger latch block 80 from the initial position to the cocked position. A middle section of flexible line 108 may be placed around anchoring notch 114. Each side of flexible line 108 may be looped around projections 102 on both sides of hook frame 82. In this way, projections 102 of hook frame 82 may provide pulleys for cocking the crossbow 70. A user may grip and pull handles 110 and 112 in the rearward direction to begin drawing bowstring 76 toward the cocked position. Pulling handles 110 and 112 in the rearward direction applies a rearward force on projections 102 of hook frame 82, which is transferred to trigger latch block 80 as a rearward draw force. In some embodiments, flexible line 108 may engage one or more hook surfaces or any other projections on hook frame 82 to draw trigger latch block 80 in the rearward direction. In alternate embodiments, crossbow 70 may include no hook frame 82. In these and other alternate embodiments, flexible line 108 may engage trigger latch block 80 directly. For example, flexible line 108 may engage lateral projections 100 or any other projections on the sides of trigger latch block 80.

Figure 19:
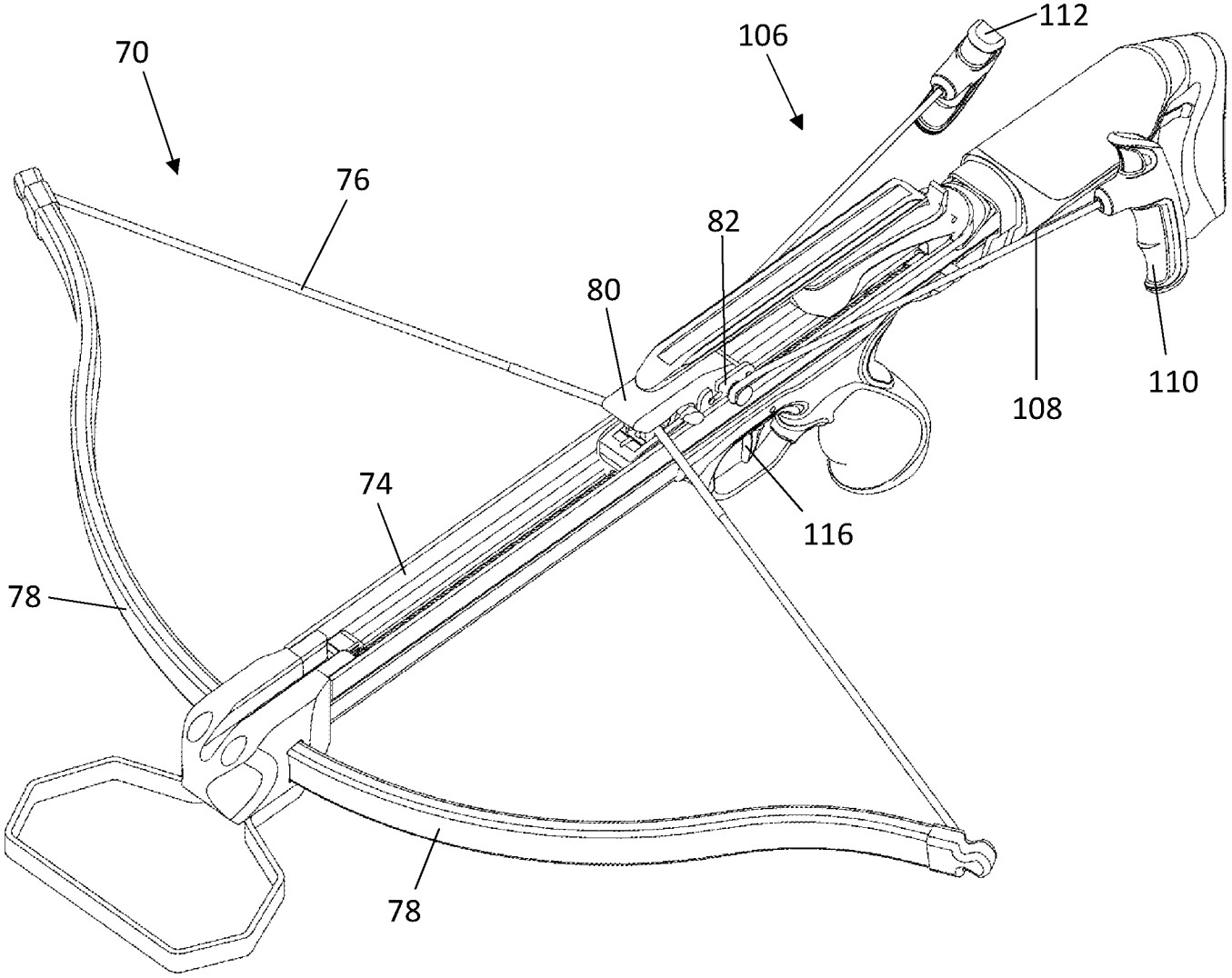
FIG. 19 is a perspective view of the trigger-traverse crossbow of FIG. 14 with the cocking device drawing the hook frame and the trigger latch block rearward into an intermediate position along the flight track.
Figure 20:
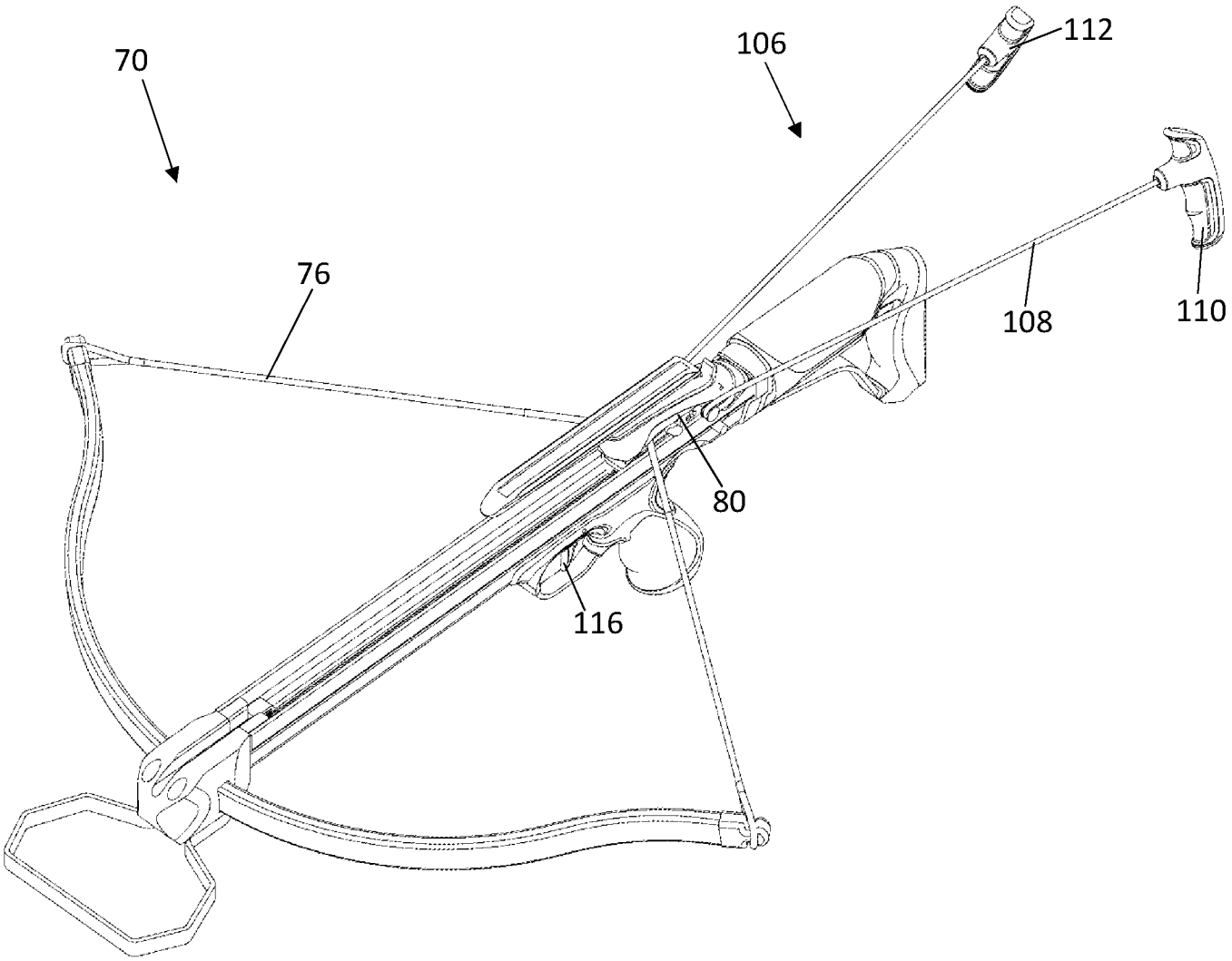
FIG. 20 is a perspective view of the trigger-traverse crossbow of FIG. 14 with the cocking device drawing the hook frame and the trigger latch block rearward into a cocked position.

With reference to FIGS. 19 and 20, trigger latch block 80 moves in the rearward direction along flight track 74 in response to the rearward draw force applied by cocking device 106 through hook frame 82. Trigger latch block 80 draws bowstring 76 rearward along flight track 74 as trigger latch block 80 moves rearward. The one-way clutch 88 (shown in FIGS. 15-16) allows rotation of helix lead screw 84, thereby allowing rearward movement of trigger latch block 80. However, if the rearward draw force is removed from hook frame 82 and trigger latch block 80 with trigger latch block 80 in an intermediate position as illustrated in FIG. 19, one-way clutch 88 prevents trigger latch block 80 from moving in the forward direction in response to forces from bowstring 76 and/or spring 86 (shown in FIGS. 15-17). In this way, the one-way retention mechanism selectively retains trigger latch block 80 in the intermediate position. Continued rearward forces applied to handles 110 and 112 of cocking device 106 draw trigger latch block 80 and bowstring 76 into the cocked position shown in FIG. 20. In the cocked position, trigger latch block 80 may engage trigger 116. As trigger latch block 80 moves in the rearward direction, trigger latch block 80 rotates helix lead screw 84 in a first direction, which winds spring 86 (shown in FIG. 16-17) and stores rotational energy therein.

Figure 21:
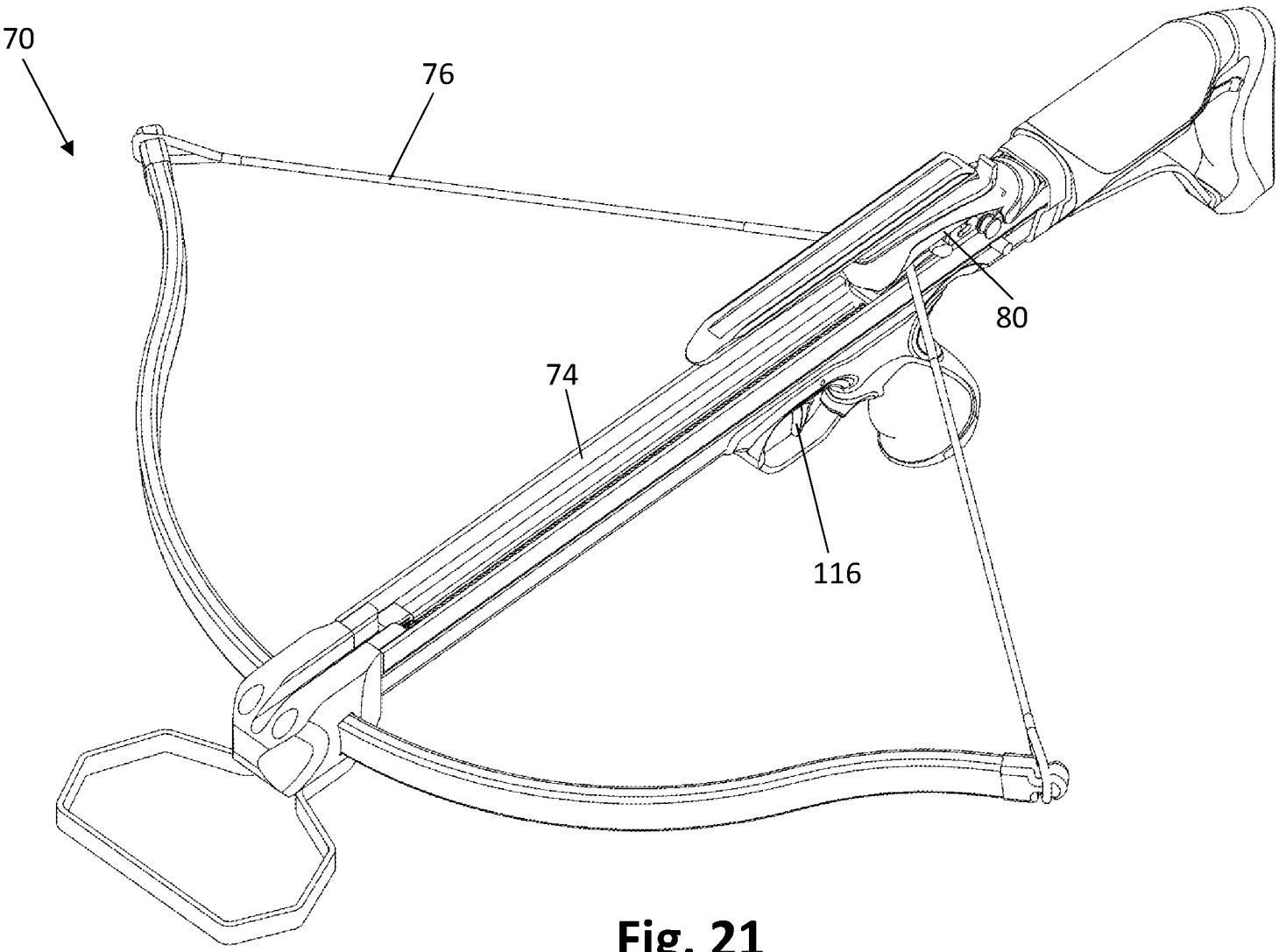
FIG. 21 is a perspective view of the trigger-traverse crossbow of FIG. 14 with the trigger latch block in the cocked position after the cocking device is removed.
Figure 22:
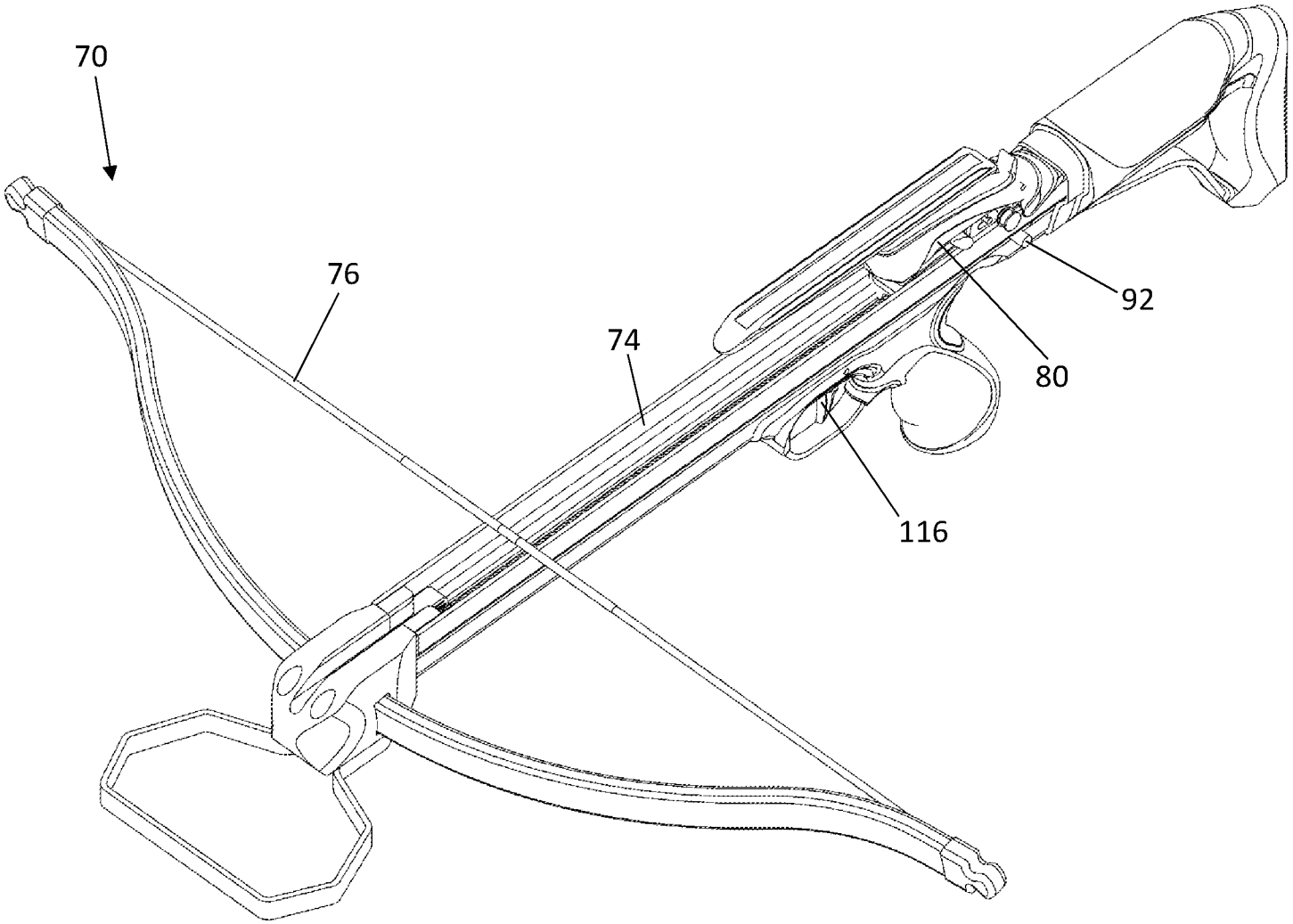
FIG. 22 is a perspective view of the trigger-traverse crossbow of FIG. 14 after the bowstring is released from the trigger latch block, with the trigger latch block remaining in the cocked position.
Figure 23:
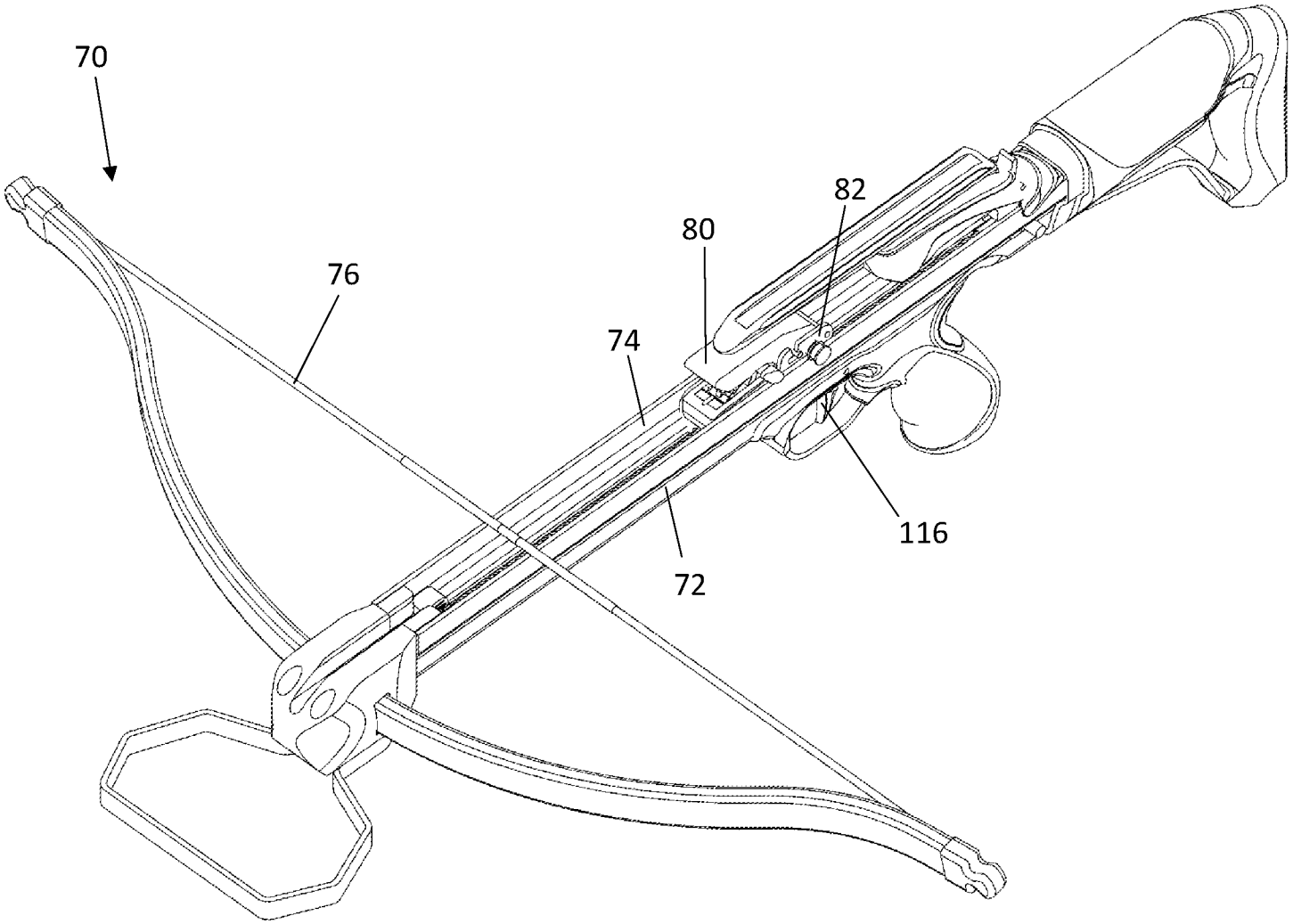
FIG. 23 is a perspective view of the trigger-traverse crossbow of FIG. 14 with the trigger latch block in an intermediate position along the flight track as a trigger-traverse mechanism returns the trigger latch block to its initial position.

Referring to FIGS. 16 and 21-23, trigger latch block 80 and bowstring 76 remain in the cocked position after cocking device 106 is removed from crossbow 70 as shown in FIG. 21. In this position, a user may position an arrow on flight track 74. Activation of trigger 116 causes latch mechanism 94 of trigger latch block 80 to release bowstring 76. When released, bowstring 76 travels in the forward direction and launches the arrow positioned on flight track 74. Bowstring 76 comes to rest in the forward position shown in FIG. 22, while trigger latch block 80 remains in the cocked position. When a user is ready to cock crossbow 70 again, the user may activate clutch release 92, which decouples one-way clutch 88 from helix lead screw 84, thereby allowing helix lead screw 84 to rotate in both directions. With one-way clutch 88 disengaged, spring 86 releases rotational energy by causing helix lead screw 84 to rotate in a second direction, which causes trigger latch block 80 to move in the forward direction along crossbow body 72 and flight track 74 from the cocked position shown in FIG. 22, through the intermediate position shown in FIG. 23, and to the initial position shown in FIG. 14.

In alternate embodiments, crossbow 70 may include a one-way retention mechanism without a trigger-traverse mechanism. In other embodiments, crossbow 70 may include a trigger-traverse mechanism without a one-way retention mechanism.

Figure 24:
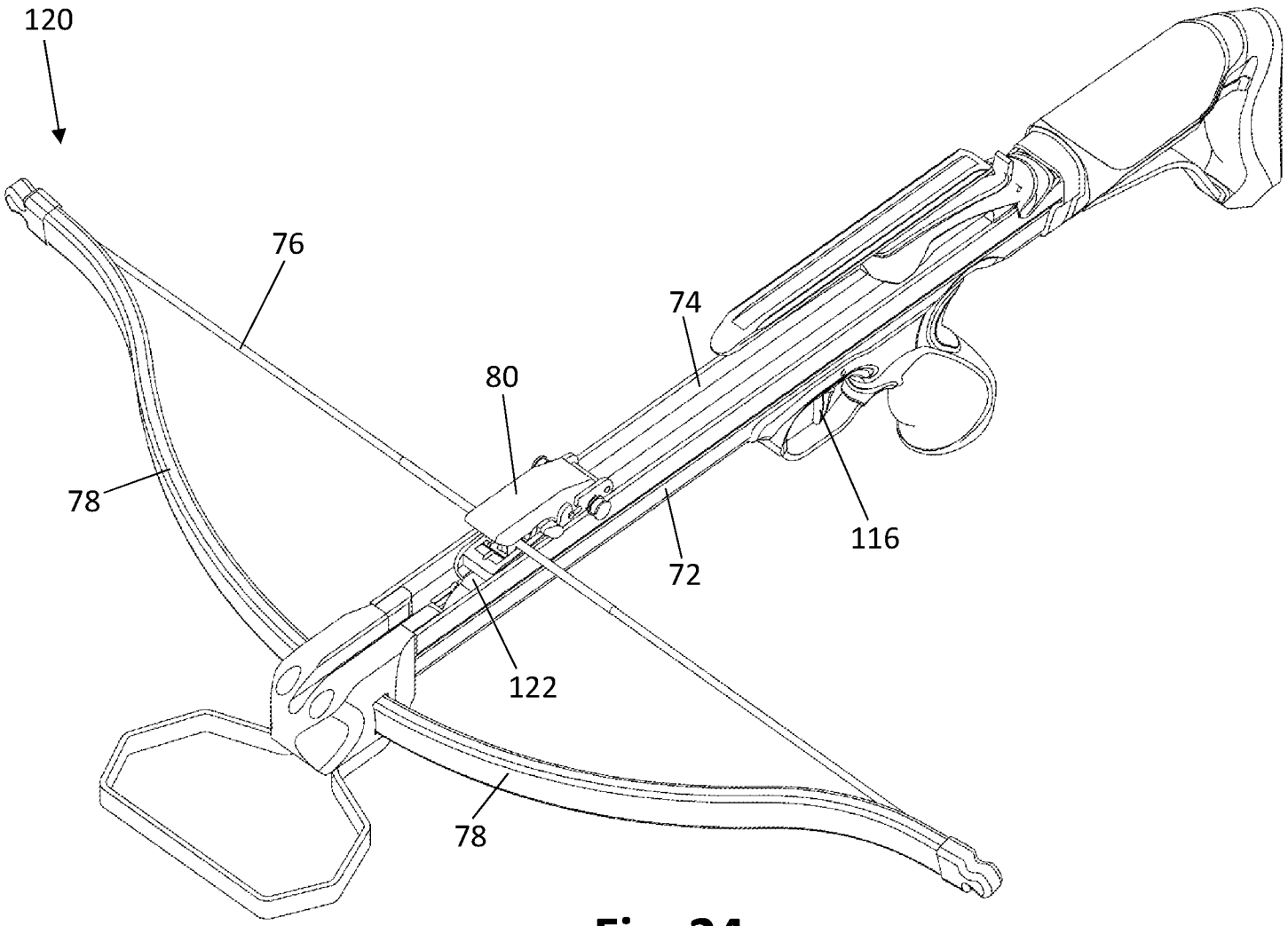
FIG. 24 is a perspective view of yet another alternate embodiment of a trigger-traverse crossbow in a default configuration with a trigger latch block in an initial position at the front of the flight track.
Figure 25:
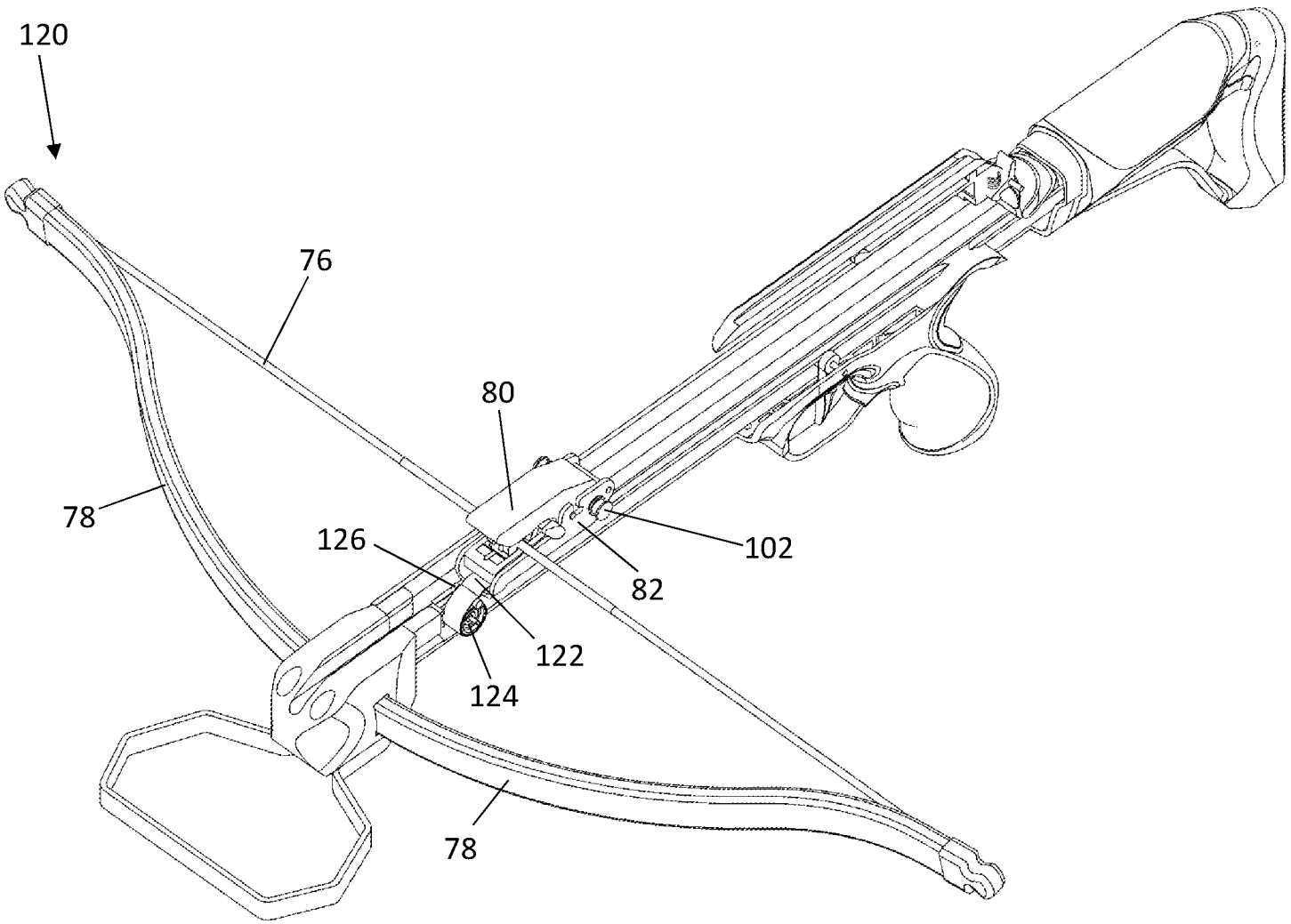
FIG. 25 is a partial cutaway perspective view of the trigger-traverse crossbow of FIG. 24.
Figure 26:
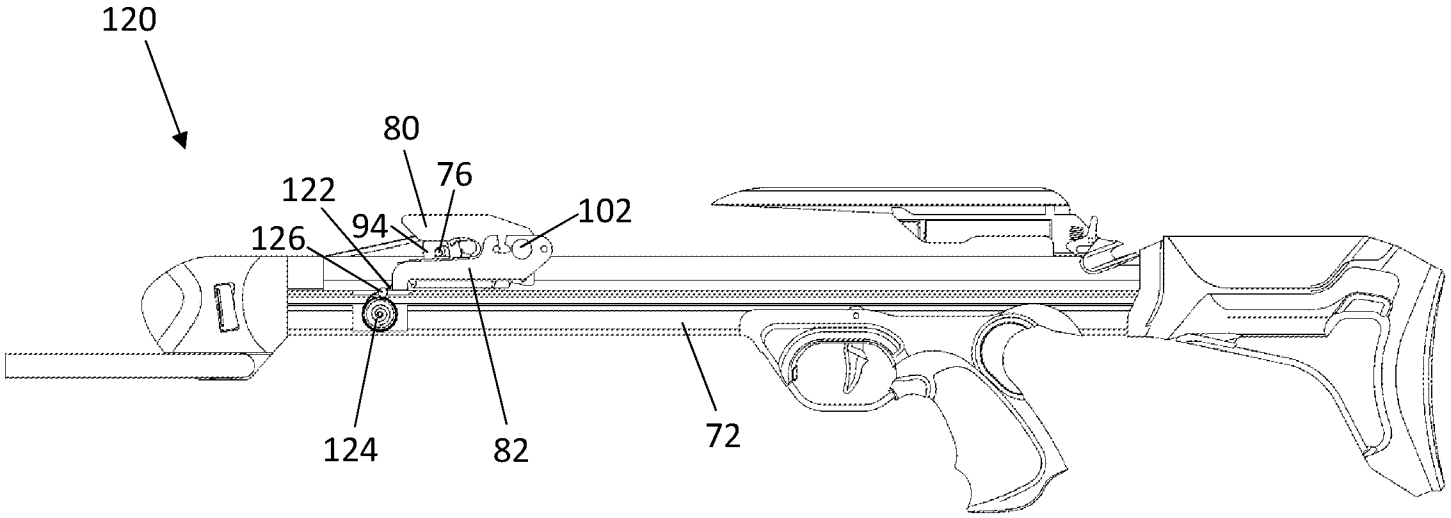
FIG. 26 is a partial cutaway side view of the trigger-traverse crossbow of FIG. 24.

FIGS. 24-26 illustrate yet another alternate embodiment of the trigger-traverse crossbow disclosed herein in a default configuration. Trigger-traverse crossbow 120 includes the same components and features of crossbow 70, except as otherwise described. Crossbow 120 includes tether 122 having one end connected to trigger latch block 80. In the initial position illustrated, a portion of tether 122 is wound around spring 124, which is disposed near a forward end of crossbow body 72. A second end of tether 122 is connected to trigger latch block 80. Spring 124 may bias tether 122 and trigger latch block 80 toward a forward end of crossbow body 72. In one embodiment, spring 124 may be a clock spring. In one embodiment, tether 122 extends over positioning post 126. Tether 122 is a guide that engages trigger latch block 80 to direct the movement of trigger latch block 80 along crossbow body 72.

Rearward movement of trigger latch block 80 in response to a rearward draw force unwinds tether 122 and charges spring 124 by storing rotational energy therein. When the rearward draw force is removed, spring 124 rotates and exerts a linear force on tether 122, which draws tether 122 in the forward direction and winds tether 122 around spring 124. The movement of tether 122 in the forward direction causes trigger latch block 80 to also move in the forward direction. In this way, spring 124 is a trigger-traverse mechanism that selectively and automatically moves trigger latch block 80 in the forward direction along flight track 74 from the cocked position to the initial position. In other embodiments, the trigger-traverse mechanism includes a mechanical or electrical component configured to move trigger latch block 80 in the forward direction along flight track 74 when the rearward draw force is removed. In some embodiments, the trigger-traverse mechanism is also configured to selectively and automatically move trigger latch block 80 in the forward direction from any position along flight track 74 to the initial position.

Figure 27:
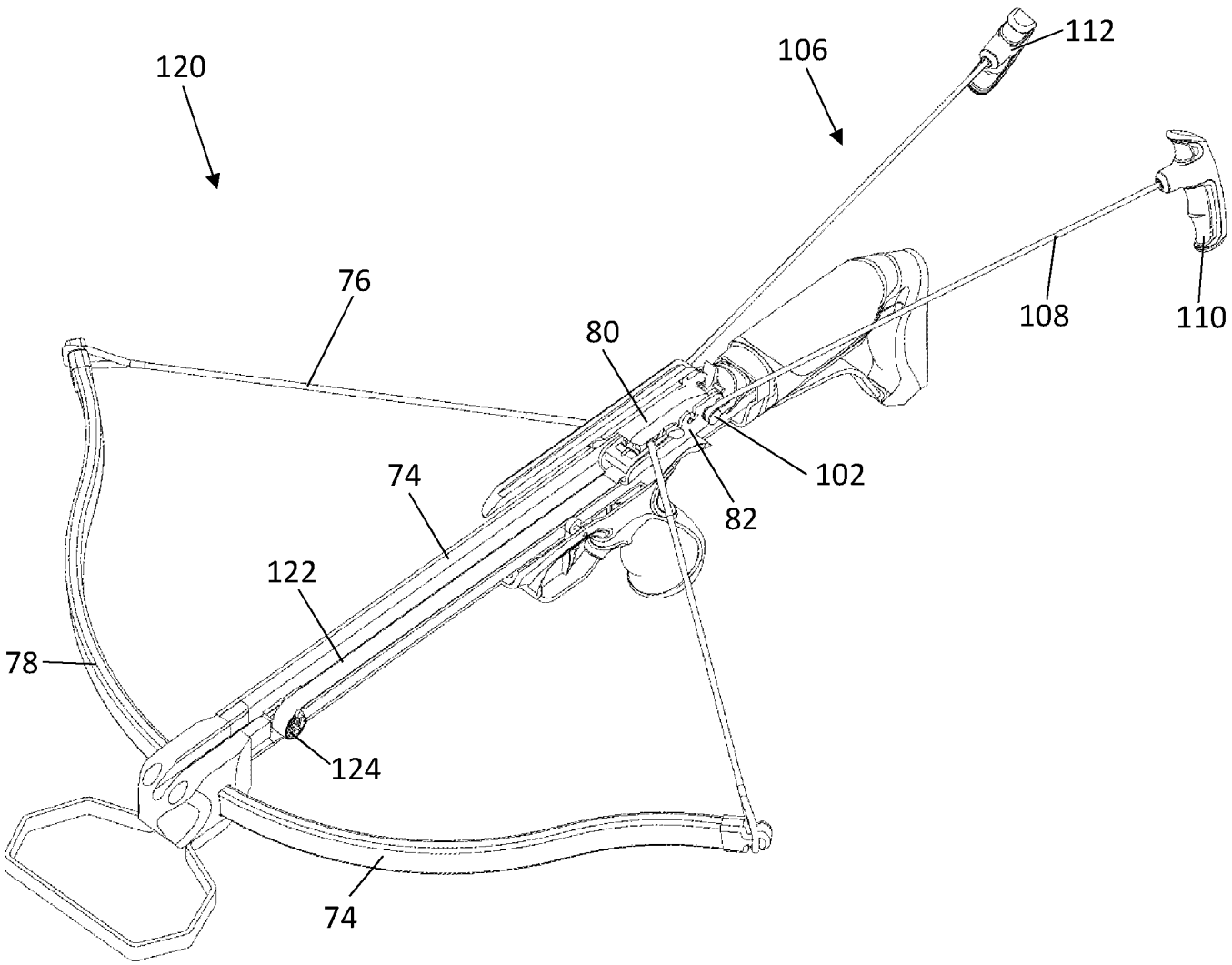
FIG. 27 is a partial cutaway perspective view of the trigger-traverse crossbow of FIG. 24 with a cocking device drawing a hook frame and the trigger latch block rearward into a cocked position along the flight track.
Figure 28:
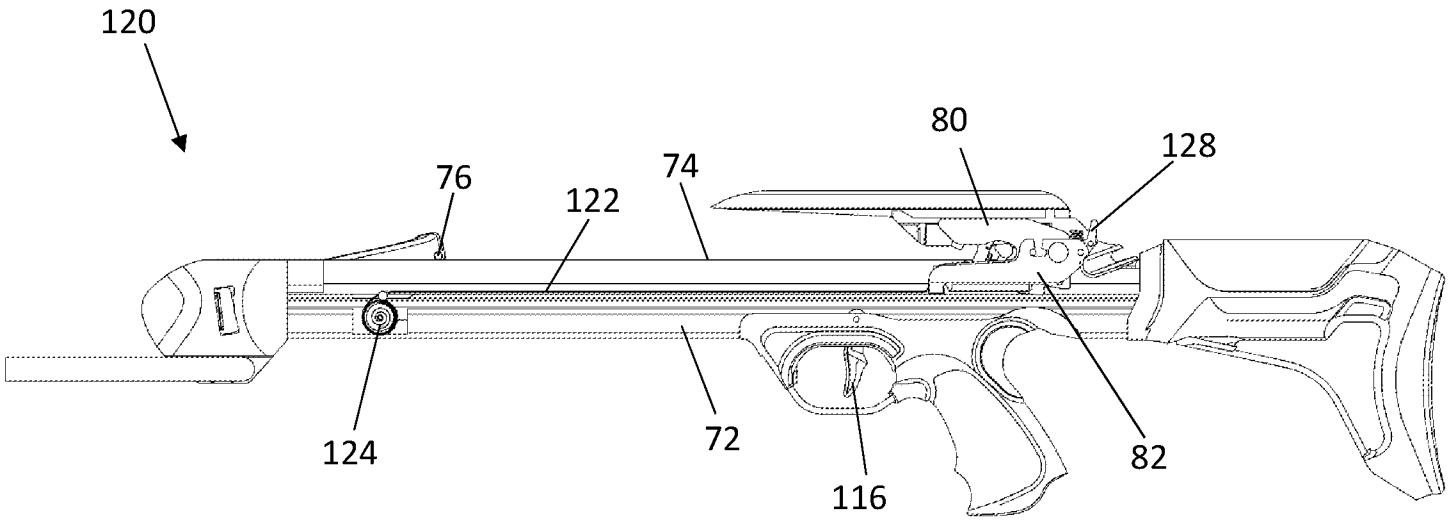
FIG. 28 is a partial cutaway side view of the trigger-traverse crossbow of FIG. 24 with the trigger latch block in the cocked position after the cocking device is removed.
Figure 29:
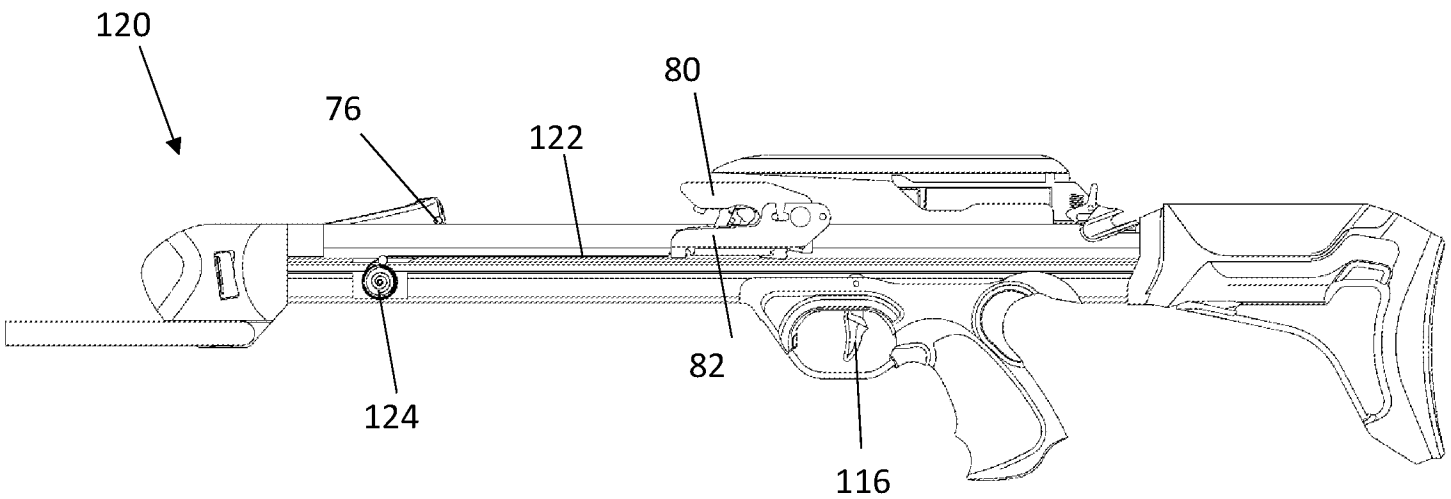
FIG. 29 is a partial cutaway side view of the trigger-traverse crossbow of FIG. 24 with the trigger latch block in an intermediate position along the flight track as a trigger-traverse mechanism returns the trigger latch block to its initial position.

With reference to FIG. 27, cocking device 106 may be attached to crossbow 120. A user may pull on handles 110 and 112 to apply a rearward force to projections 102 of hook frame 82. The rearward force may be transferred from hook frame 82 to trigger latch block 80, resulting in trigger latch block 80 and bowstring 76 being drawn in the rearward direction along flight track 74 until reaching the cocked position illustrated. As shown in FIG. 28, activating trigger 116 may cause trigger latch block 80 to release bowstring 76 for forward movement and to launch an arrow positioned on flight track 74. Bowstring 76 may stop in the initial position illustrated in FIG. 28, while trigger latch block 80 remains in the cocked position. With reference to FIG. 29, when a user is ready to cock crossbow 120 again, the user may activate release 128, which may disengage trigger latch block 80 from trigger 116. This allows spring 124 to exert a forward linear force on tether 122 in order to wind tether 122 around spring 124 and to move trigger latch block in the forward direction until reaching the initial position illustrated in FIG. 24. In alternate embodiments, crossbow 120 may include no hook frame 82. In these and other alternate embodiments, flexible line 108 may engage trigger latch block 80 directly. For example, flexible line 108 may engage lateral projections 100 or any other projections on the sides of trigger latch block 80.

Optionally, crossbow 120 may further include a one-way retention mechanism configured to selectively retain trigger latch block 80 against forward movement along flight track 74 when engaged. For example, the one-way retention mechanism may engage tether 122, trigger latch block 80, hook frame 82, or spring 124 in order to allow rearward movement of trigger latch block 80 while preventing forward movement of trigger latch block 80 when engaged. Activation of a retention release may disengage the one-way retention mechanism to allow forward movement of trigger latch block 80. The one-way retention mechanism in these embodiments may include the same components and features as the one-way retention mechanism in crossbow 70.

In alternate embodiments of crossbows 70 and 120, other cocking mechanisms may be used to draw the trigger latch block and bowstring in the rearward direction into the cocked position. In still other embodiments, crossbows 70 and 120 may be any type of crossbow, such as a recurve crossbow, compound crossbow, or any other type of crossbow.

Each device described in this disclosure may include any combination of the described components, features, and/or functions of each of the individual device embodiments. Each method described in this disclosure may include any combination of the described steps in any order, including the absence of certain described steps and combinations of steps used in separate embodiments. Any range of numeric values disclosed herein includes any subrange therein.

The advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense. While preferred embodiments have been described, it is to be understood that the embodiments are illustrative only and that the scope of the invention is to be defined solely by the appended claims when accorded a full range of equivalents, many variations and modifications naturally occurring to those skilled in the art from a review hereof.

I claim:

1. A crossbow comprising:

a crossbow body having a flight track;

a bowstring coupled to the crossbow body and extending across the crossbow body;

a trigger latch block slidingly connected to the crossbow body, wherein the trigger latch block is configured to draw the bowstring in a rearward direction along the flight track; wherein the trigger latch block is configured to be drawn in the rearward direction along the flight track from an initial position to a cocked position in response to a rearward draw force;

a one-way retention mechanism including a one-way clutch configured to selectively retain the trigger latch block against linear movement in a forward direction along the flight track;

a guide engaging the trigger latch block; wherein the one-way clutch engages the guide to prevent linear movement of the trigger latch block in the forward direction along the flight track; and a trigger configured to engage the trigger latch block in the cocked position, wherein the trigger is configured to selectively cause the trigger latch block to release the bowstring.

2. The crossbow of claim 1, wherein the guide comprises a helix lead screw threadedly engaging the trigger latch block.

3. The crossbow of claim 2, wherein the helix lead screw has a steep, high helix thread pitch.

4. The crossbow of claim 1, wherein the guide comprises a tether having a rearward section secured to the trigger latch block.

5. The crossbow of claim 1, further comprising a hook frame slidingly connected to the crossbow body and engaging the trigger latch block; wherein the hook frame is configured to transfer a rearward force applied on the hook frame to the trigger latch block to provide the rearward draw force for drawing the trigger latch block in the rearward direction along the flight track from the initial position to the cocked position.

6. The crossbow of claim 5, wherein the hook frame includes a projection on two sides.

7. The crossbow of claim 1, wherein activation of a clutch release disengages the one-way clutch from the guide.

8. The crossbow of claim 7, further comprising a trigger-traverse mechanism configured to selectively and automatically move the trigger latch block in the forward direction along the flight track from the cocked position to the initial position after the bowstring is released and in response to activation of the clutch release.

9. The crossbow of claim 8, wherein the trigger-traverse mechanism includes a spring engaging the guide; wherein the spring is charged in response to rearward movement of the trigger latch block along the flight track; wherein the spring is configured to move the trigger latch block in the forward direction along the flight track in response to activation of the clutch release.

10. The crossbow of claim 8, wherein the trigger-traverse mechanism includes a mechanical or electrical component engaging the guide and configured to move the trigger latch block in the forward direction along the flight track in response to activation of the clutch release.

11. A crossbow kit comprising: the crossbow of claim 1 and a cocking mechanism configured to cause the trigger latch block to move in the rearward direction along the flight track from the initial position to the cocked position.

12. The crossbow kit of claim 11, wherein the cocking mechanism comprises a flexible line configured to engage the trigger latch block.

13. The crossbow kit of claim 11, further comprising a hook frame slidingly connected to the crossbow body and engaging the trigger latch block; wherein the cocking mechanism comprises a flexible line configured to engage the hook frame; wherein the hook frame is configured to transfer a rearward force applied on the hook frame to the trigger latch block.

14. A crossbow comprising:

a crossbow body having a flight track;

a bowstring coupled to the crossbow body and extending across the crossbow body;

a trigger latch block slidingly connected to the crossbow body, wherein the trigger latch block is configured to draw the bowstring in a rearward direction along the flight track; wherein the trigger latch block is configured to be drawn in the rearward direction along the flight track from an initial position to a cocked position in response to a rearward draw force;

a guide configured to engage the trigger latch block;

a trigger configured to engage the trigger latch block in the cocked position, wherein the trigger is configured to selectively cause the trigger latch block to release the bowstring; and a trigger-traverse mechanism engaging the guide and configured to selectively and automatically move the trigger latch block in a forward direction along the flight track from the cocked position to the initial position after the rearward draw force is removed and the bowstring is released from the trigger latch block.

15. The crossbow of claim 14, wherein the trigger-traverse mechanism includes a spring engaging the guide; wherein the spring is charged in response to rearward movement of the trigger latch block along the flight track; wherein the spring is configured to move the trigger latch block in the forward direction along the flight track in response to activation of a release.

16. The crossbow of claim 15, wherein the guide comprises a helix lead screw threadedly engaging the trigger latch block; wherein the spring is charged in response to rotation of the helix lead screw resulting from rearward movement of the trigger latch block along the flight track; wherein the spring is configured to rotate the helix lead screw in order to move the trigger latch block in the forward direction along the flight track in response to activation of the release.

17. The crossbow of claim 15, wherein the guide comprises a tether having a forward section secured to the spring and a rearward section secured to the trigger latch block; wherein the spring is charged in response to rearward movement of the tether and trigger latch block along the flight track; wherein the spring is configured to retract the rearward end of the tether to move the trigger latch block in the forward direction along the flight track in response to activation of the release.

18. The crossbow of claim 15, wherein the spring is a clock spring that is wound in response to rearward movement of the trigger latch block along the flight track; wherein the clock spring releases rotational energy to move the trigger latch block in the forward direction along the flight track in response to activation of the release.

19. The crossbow of claim 14, wherein the trigger-traverse mechanism includes a mechanical or electrical component engaging the guide and configured to move the trigger latch block in the forward direction along the flight track in response to activation of a release.

20. The crossbow of claim 14, further comprising a one-way retention mechanism configured to selectively retain the trigger latch block against linear movement in the forward direction along the flight track.

21. The crossbow of claim 20, wherein the one-way retention mechanism includes a one-way clutch engaging the guide to prevent linear movement of the trigger latch block in the forward direction along the flight track; wherein activation of a clutch release disengages the one-way clutch from the guide.

22. The crossbow of claim 21, wherein the guide comprises a helix lead screw threadedly engaging the trigger latch block.

23. The crossbow of claim 21, wherein the guide comprises a tether having a rearward section secured to the trigger latch block.

24. The crossbow of claim 14, further comprising a hook frame slidingly connected to the crossbow body and engaging the trigger latch block; wherein the hook frame is configured to transfer a rearward force applied on the hook frame to the trigger latch block to provide the rearward draw force for drawing the trigger latch block in the rearward direction along the flight track from the initial position to the cocked position.

25. A crossbow kit comprising: the crossbow of claim 14 and a cocking mechanism configured to cause the trigger latch block to move in the rearward direction along the flight track from the initial position to the cocked position.

26. The crossbow kit of claim 25, wherein the cocking mechanism comprises a flexible line configured to engage the trigger latch block.

27. The crossbow kit of claim 25, further comprising a hook frame slidingly connected to the crossbow body and engaging the trigger latch block; wherein the cocking mechanism comprises a flexible line configured to engage the hook frame; wherein the hook frame is configured to transfer a rearward force applied on the hook frame to the trigger latch block.

* * * * *